US006342341B1

(12) United States Patent
Reed et al.

(10) Patent No.: US 6,342,341 B1
(45) Date of Patent: Jan. 29, 2002

(54) FRAGMENTABLE ELECTRON DONOR COMPOUNDS USED IN CONJUNCTION WITH EPITAXIALLY SENSITIZED SILVER HALIDE EMULSIONS

(75) Inventors: Kenneth J. Reed, Rochester; Jerome R. Lenhard; David E. Fenton, both of Fairport, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/468,055

(22) Filed: Dec. 20, 1999

(51) Int. Cl.[7] ..... G03C 1/08
(52) U.S. Cl. ..... 430/567; 430/569; 430/583
(58) Field of Search ..... 430/583, 567, 430/569

(56) References Cited

U.S. PATENT DOCUMENTS

| | | | | | |
|---|---|---|---|---|---|
| 4,435,501 | A | | 3/1984 | Maskasky | |
| 4,471,050 | A | | 9/1984 | Maskasky | |
| 4,933,272 | A | * | 6/1990 | McDugle et al. | 430/567 |
| 4,945,035 | A | * | 7/1990 | Keevert, Jr. et al. | 430/567 |
| 5,037,732 | A | * | 8/1991 | McDugle et al. | 430/567 |
| 5,503,970 | A | | 4/1996 | Olm et al. | |
| 5,582,965 | A | * | 12/1996 | Deaton et al. | 430/567 |
| 5,631,126 | A | | 5/1997 | Daubendiek et al. | |
| 5,747,235 | A | | 5/1998 | Farid et al. | |
| 5,747,236 | A | * | 5/1998 | Farid et al. | 430/583 |
| 5,804,363 | A | * | 9/1998 | Maskasky et al. | 430/567 |
| 5,935,774 | A | * | 8/1999 | Bringley et al. | 430/567 |
| 5,944,051 | A | | 8/1999 | Johnson | |
| 6,010,841 | A | * | 1/2000 | Farid et al. | 430/583 |
| 6,054,260 | A | | 4/2000 | Adin et al. | |
| 6,090,536 | A | * | 7/2000 | Maskasky et al. | 430/567 |
| 6,100,019 | A | * | 8/2000 | Brust et al. | 430/569 |
| 6,114,105 | A | * | 9/2000 | Brust et al. | 430/567 |

FOREIGN PATENT DOCUMENTS

| | | |
|---|---|---|
| EP | 1011017 A | 6/2000 |
| EP | 1011018 A | 6/2000 |
| EP | 1011025 A | 6/2000 |
| EP | 1011026 A | 6/2000 |
| US | 5614359 A | 3/1997 |

OTHER PUBLICATIONS

Research Disclosure 36544 Section I. D. (3), Sep. 1994.*

* cited by examiner

*Primary Examiner*—Janet Baxter
*Assistant Examiner*—Amanda C. Walke
(74) *Attorney, Agent, or Firm*—Edith A. Rice

(57) ABSTRACT

This invention comprises a silver halide photographic element comprising at least one sensitive silver halide emulsion layer comprising silver halide grains that have been epitaxially sensitized and a fragmentable electron donor compound is of the formula X—Y' or a compound which contains a moiety of the formula —X—Y';
wherein X is an electron donor moiety, Y' is a leaving proton H or a leaving group Y, with the proviso that if Y' is a proton, a base, $\beta^-$, is covalently linked directly or indirectly to X, and wherein:

1) X—Y' has an oxidation potential between 0 and about 1.4 V; and 2) the oxidized form of X—Y' undergoes a bond cleavage reaction to give the radical $X^{\bullet}$ and the leaving fragment Y';

and, optionally, 3) the radical $X^{\bullet}$ has an oxidation potential $\leqq -0.7V$ (that is, equal to or more negative than about −0.7V).

24 Claims, No Drawings

FRAGMENTABLE ELECTRON DONOR COMPOUNDS USED IN CONJUNCTION WITH EPITAXIALLY SENSITIZED SILVER HALIDE EMULSIONS

FIELD OF THE INVENTION

This invention relates to a photographic element comprising an epitaxially sensitized emulsion which further comprises a fragmentable electron donor compound.

DEFINITIONS

A tabular grain emulsion is one in which at least 50 percent of total grain projected area is accounted for by tabular grains.

As employed herein the term "tabular grain" is employed to indicate grains that have two parallel major faces substantially larger than any remaining face and that exhibit an aspect ratio of at least 2.

Aspect ratio is the ratio of tabular grain equivalent circular diameter (ECD) divided by thickness (t). The average aspect ratio of a tabular grain emulsion is the ratio of average grain ECD divided by average grain thickness.

An epitaxially sensitized silver halide emulsion is an emulsion which comprises silver halide grains which bear at least one silver salt epitaxially grown thereon. The anion content of the silver salt and the tabular silver halide grains differ sufficiently to permit differences in the respective crystal structures to be detected.

In referring to grains and emulsions containing two or more halides, the halides are named in order of ascending concentrations.

BACKGROUND OF THE INVENTION

The use of fragmentable electron donor (FED) compounds to enhance the dyed spectral response of silver halide emulsions has been demonstrated to be quite effective. Fragmentable electron donating compounds are described in U.S. Pat. Nos. 5,747,235 and 5,747,236 and commonly assigned co-pending U.S. applications Ser. No. 08/739,911 filed Oct. 30, 1996, and Ser. Nos. 09/118,536, 09/118,552 and 09/118,714 filed Jul. 25, 1998, the entire disclosures thereof are incorporated herein by reference.

Silver salt epitaxy has become an extremely useful tool for the sensitization of silver halide photographic emulsions, particularly those emulsions that are tabular in grain morphology. Here the word epitaxy is used in its common usage, to refer to the union of two dissimilar materials. This union is usually observed as a distinct interface. The materials that form an isomorphic silver salt epitaxy: silver chloride, silver bromide and silver iodide, exhibit a face centered cubic crystal structure.

Maskasky U.S. Pat. No. 4,435,501 recognizes that a site director such as iodide ion, or a spectral sensitizing dye adsorbed to the surfaces of the host tabular grain directs isomorphic silver salt epitaxy to selected sites, typically the edges and /or corners of the host grains. Depending upon the composition and site of the silver salt epitaxy, significant increases in speed are observed. The most highly controlled site depositions, (e.g. corner specific epitaxy siting) and highest reported photograhic speeds are achieved by epitaxially depositing silver chloride onto silver iodobromide tabular grains.

Another form of epitaxy disclosed by Maskasky U.S. Pat. No. 4,471,050 involves non-isomorphic silver salts. These silver salts such as silver thiocyanate, beta and ganuna phase silver iodide, silver phosphate and silver carbonate do not require a site director nor do these materials belong to face centered cubic crystal rock salt structure. Epitaxies with these materials typically show somewhat less significant speed increases. Thus the isomorphic silver salt epitaxy has been practiced more widely and receives most attention in the patent literature.

Daubendiek et al U.S. Pat. No. 5,503,971 observes photographic performance advantages using ultrathin (<0.07 $\mu$m thick) tabular grain emulsions that had been chemically and then spectrally sensitized with silver salt epitaxy. These improvements in ultrathin emulsion speed-granularity relationships occur for certain host grain iodide concentration profiles which preferentially receive the silver salt epitaxy.

Olm et al U.S. Pat. No. 5,503,970 disclose improvements over the invention of Daubendiek et al by incorporating a dopant into the silver salt epitaxy.

These improvements in tabular grain and ultrathin tabular grain performance notwithstanding, there still remains an unmet need for higher speed and lower granularity emulsions. This unsatisfied need is especially acute in the area of high speed photography (>400 ISO speed) where considerations of shutter speed, depth of field, stop action, and low light levels become paramount.

PROBLEM TO BE SOLVED BY THE INVENTION

While the use of fragmentable electron donors increase the speed of the emulsions disclosed in the above mentioned patents and patent applications, it is still desirable to have silver halide emulsion of even greater speed. Further, it is desirable to have silver halides sensitized with FEDs without the increase in fog obtained by the use of FEDs.

SUMMARY OF THE INVENTION

We have now found that FED compounds can advantageously be used to enhance the spectral speed of emulsions featuring corner epitaxy. The FED compounds impart additional speed over and above that afforded by the epitaxy on the host emulsion alone. Further, the use of an epitaxially sensitized silver halide emulsion in accordance with a preferred embodiment of the invention, are particularly effective in controlling the Dmin increases (i.e.,fog) associated with FED's. The inclusion of a transition metal dopant such as ruthenium hexacyanide, $[Ru(CN)_6]^{4-}$, in the epitaxy is also effective is suppressing the fog induced by the FED'S.

One aspect of this invention comprises a silver halide photographic element comprising at least one radiation sensitive silver halide emulsion layer comprising silver halide grains that have been epitaxially sensitized and a fragmentable electron donor compound of the formula X—Y' or a compound which contains a moiety of the formula —X—Y';

wherein

X is an electron donor moiety, Y' is a leaving proton H or a leaving group Y, with the proviso that if Y' is a proton, a base, $\beta^-$, is covalently linked directly or indirectly to X, and wherein:

1) X—Y ' has an oxidation potential between 0 and about 1.4 V; and 2) the oxidized form of X—Y ' undergoes a bond cleavage reaction to give the radical $X^{\bullet}$ and the leaving fragment Y';

and, optionally, 3) the radical $X^{\bullet}$ has an oxidation potential $\leqq -0.7V$ (that is, equal to or more negative than about −0.7V).

ADVANTAGEOUS EFFECT OF THE INVENTION

This invention provides a silver halide emulsion with increased photographic speed with relatively low fog.

DETAILED DESCRIPTION OF THE INVENTION

The present invention is generally applicable to epitaxially sensitized tabular silver halide grain emulsions. In preferred embodiments of the invention the emulsion comprises tabular grains with greater than 50 percent of total grain projected area is accounted for by tabular grains. In particularly preferred embodiments of the invention the emulsion comprises a high bromide emulsion in which greater than 50 percent of total grain projected area is accounted for by tabular grains having {111} major faces and containing greater than 50 mole percent bromide, based on silver. The following high bromide {111} tabular grain emulsion precipitation procedures, here incorporated by reference, are specifically contemplated to be useful in the practice of the invention:

Daubendiek et al U.S. Pat. No. 4,414,310;
Abbott et al U.S. Pat. No. 4,425,426;
Wilgus et al U.S. Pat. No. 4,434,226;
Maskasky U.S. Pat. No. 4,435,501;
Kofron et al U.S. Pat. No. 4,439,520;
Solberg et al U.S. Pat. No. 4,433,048;
Evans et al U.S. Pat. No. 4,504,570;
Yamada et al U.S. Pat. No. 4,647,528;
Daubendiek et al U.S. Pat. No. 4,672,027;
Daubendiek et al U.S. Pat. No. 4,693,964;
Sugimoto et al U.S. Pat. No. 4,665,012;
Daubendiek et al U.S. Pat. No. 4,672,027;
Yamada et al U.S. Pat. No. 4,679,745;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitou et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Daubendiek et al U.S. Pat. No. 4,914,014;
Aida et al U.S. Pat. No. 4,962,015;
Ikeda et al U.S. Pat. No. 4,985,350;
Piggin et al U.S. Pat. No. 5,061,609;
Piggin et al U.S. Pat. No. 5,061,616;
Tsaur et al U.S. Pat. No. 5,147,771;
Tsaur et al U.S. Pat. No. 5,147,772;
Tsaur et al U.S. Pat. No. 5,147,773;
Tsaur et al U.S. Pat. No. 5,171,659;
Tsaur et al U.S. Pat. No. 5,210,013;
Antoniades et al U.S. Pat. No. 5,250,403;
Kim et al U.S. Pat. No. 5,272,048;
Delton U.S. Pat. No. 5,310,644;
Chang et al U.S. Pat. No. 5,314,793;
Sutton et al U.S. Pat. No. 5,334,469;
Black et al U.S. Pat. No. 5,334,495;
Chaffee et al U.S. Pat. No. 5,358,840; and
Delton U.S. Pat. No. 5,372,927.

The preferred high bromide {111} tabular grain emulsions that are formed preferably contain at least 70 (optimally at least 90) mole percent bromide, based on silver. Silver bromide, silver iodobromide, silver chlorobromide, silver iodochlorobromide, and silver chloroiodobromide tabular grain emulsions are specifically contemplated. Although silver chloride and silver bromide form tabular grains in all proportions, chloride is preferably present in concentrations of 30 mole percent, based on silver, or less. Iodide can be present in the tabular grains up to its solubility limit under the conditions selected for tabular grain precipitation. Under ordinary conditions of precipitation silver iodide can be incorporated into the tabular grains in concentrations ranging up to about 40 mole percent, based on silver. It is generally preferred that the iodide concentration be less than 20 mole percent, based on silver. Typically the iodide concentration is less than 10 mole percent, based on silver. To facilitate rapid processing, such as commonly practiced in radiography, it is preferred that the iodide concentration be limited to less than 4 mole percent, based on silver. Significant photographic advantages can be realized with iodide concentrations as low as 0.5 mole percent, based on silver, with an iodide concentration of at least 1 mole percent, based on silver, being preferred.

The high bromide {111} tabular grain emulsions can exhibit mean grain ECD's of any conventional value, ranging up to 10 $\mu$m, which is generally accepted as the maximum mean grain size compatible with photographic utility. In practice, the tabular grain emulsions of the invention typically exhibit a mean ECD in the range of from about 0.2 to 7.0 $\mu$m. Tabular grain thicknesses typically range from about 0.03 $\mu$m to 0.3 $\mu$m. For blue recording somewhat thicker grains, up to about 0.5 $\mu$m, can be employed. For minus blue (red and/or green) recording, thin (<0.2 $\mu$m) tabular grains are preferred.

The advantages that tabular grains impart to emulsions generally increases as the average aspect ratio or tabularity of the tabular grain emulsions increases. Both aspect ratio (ECD/t) and tabularity (ECD/$t^2$, where ECD and t are measured in $\mu$m) increase as average tabular grain thickness decreases. Therefore it is generally sought to minimize the thicknesses of the tabular grains to the extent possible for the photographic application. Absent specific application prohibitions, it is generally preferred that the tabular grains having a thickness of less than 0.3 $\mu$m (preferably less than 0.2 $\mu$m and optimally less than 0.07 $\mu$m) and accounting for greater than 50 percent (preferably at least 70 percent and optimally at least 90 percent) of total grain projected area exhibit an average aspect ratio of greater than 5 and most preferably greater than 8. Tabular grain average aspect ratios can range up to 100, 200 or higher, but are typically in the range of from about 12 to 80. Tabularities of >25 are generally preferred.

Conventional dopants can be incorporated into the tabular grains during their precipitation, as illustrated by the patents cited above and *Research Disclosure,* September 1996, Number 389, Item 38957, Section I. Emulsion grains and their preparation, D. Grain modifying conditions and adjustments, paragraphs (3), (4) and (5). (*Research Disclosure,* September 1996, Number 389, Item 38957 will be identified hereafter by the term "Research Disclosure I." The Sections hereafter referred to are Sections of the Research Disclosure I unless otherwise indicated. All Research Disclosures referenced are published by Kenneth Mason Publications, Ltd., Dudley Annex, 12a North Street, Emsworth, Hampshire P010 7DQ, ENGLAND. It is specifically contemplated to incorporate dopants capable of increasing imaging speed by forming a shallow electron trap (hereinafter also referred to as SET dopants), further disclosed in *Research Disclosure,* Vol. 367, November 1994, Item 36736, and Olm et al U.S. Pat. No. 5,576,171, here incorporated by reference.

The SET dopants are effective at any location within the grains. Generally better results are obtained when the SET dopant is incorporated in the -.:j exterior 50 percent of the grain, based on silver. An optimum grain region for SET incorporation is that formed by silver ranging from 50 to 95 percent of total silver forming the grains. For epitaxially sensitized emulsions, incorporation of the dopant into the epitaxial deposition is particularly preferred. The SET can be introduced all at once or run into the reaction vessel over a period of time while grain precipitation is continuing. Generally SET forming dopants are contemplated to be incorporated in concentrations of at least $1\times10^{-7}$ mole per silver mole up to their solubility limit, typically up to about $5\times10^{-4}$ mole per silver mole.

Particularly preferred dopants are complexes with rhenium, ruthenium or osmium, as disclosed in U.S. Pat. No. 4,945,035, Keevert, et al., the entire disclosure of which is incorporated herein by reference. Ruthenium hexacyanide is particularly preferred.

Epitaxial deposition of a silver salt onto the edges and/or corners of tabular grains is well known and is described in numerous patents and other publications. Of specific interest to the present invention are:

U.S. Pat. No. No. 4,43 5,501 (Maskasky) discusses dye directed epitaxy;

U.S. Pat. No. 5,573,902 Daubendiek et al discloses thin low iodide silver halide tabular grains (≦0.07 um) having increased contrast, speed and lower granularity;

U.S. Pat. No. 5,576,168 (Daubendiek et al) discloses emulsions ≦0.07 um, dye directed epitaxy, mixed halide salt epitaxy and preferred dopant level and position;

U.S. Pat. No. 5,582,965 (Deaton et al.) discusses thin tabular emulsions and iodide introduction into the epitaxy;

U.S. Pat. No. 5,503,970 (Olm et al.) describes dopant management,specifically the placement of SET dopants into the epitaxial protrusions where they act as shallow electron traps;

U.S. Pat. No. 5,503,971 (Daubendiek) describes emulsions in which central region is of lower iodide than perimeter region, and two coated layers;

U.S. Pat. No. 5,536,632 (Wen et al.) describes dopants and specifically two dopant combinations involving Se (partitioned into the grain) and a shallow electron trapping dopant where theoptimal placement is in epitaxy. Epitaxy is also discussed in *Research Disclosure,* September 1996, Number 389, Item 38957, Section I.

Epitaxially sensitized silver halide emulsions for use in accordance with this invention can be prepared using the processes described in the above references, the entire disclosures of which are incorporated herein by reference. Dye directed epitaxy is particularly preferred.

The silver halide emulsion may be spectrally sensitized by sensitizing dyes by any method known in the art, such as described in *Research Disclosure I.* The dye may be added to an emulsion of the silver halide grains and a hydrophilic colloid at any time prior to (e.g., during or after chemical sensitization) or simultaneous with the coating of the emulsion on a photographic element. The dyes may, for example, be added as a solution in water or an alcohol. As discussed above, for these epitaxially sensitized emulsions, sensitizing dye is preferrably present before the formation of the epitaxy. The dye/silver halide emulsion may be mixed with a dispersion of color image-forming coupler immediately before coating or in advance of coating (for example, 2 hours).

Spectral sensitizing dyes can be used together with the fragmentable electron donor in the practice of this invention. Preferred sensitizing dyes that can be used are cyanine, merocyanine, styryl, hemicyanine, or complex cyanine dyes.

Illustrative sensitizing dyes that can be used are dyes of the following general structures (SD-1) through (SD-5):

(SD-1)

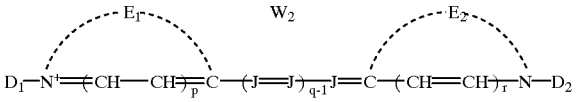

wherein:

$E_1$ and $E_2$ represent the atoms necessary to form a substituted or unsubstituted hetero ring and may be the same or different, each J independently represents a substituted or unsubstituted methine group, q is a positive integer of from 1 to 4, p and r each independently represents 0 or 1, $D_1$ and $D_2$ each independently represents substituted or unsubstituted alkyl or unsubstituted aryl, and $W_2$ is a counterion as necessary to balance the charge;

(SD-2)

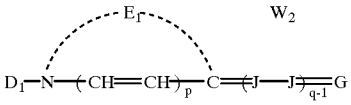

wherein $E_1$, $D_1$, J, p, q and $W_2$ are as defined above for formula (SD-1) and G represents

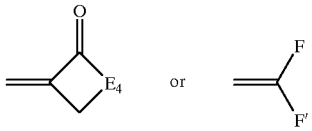

wherein $E_4$ represents the atoms necessary to complete a substituted or unsubstituted heterocyclic nucleus, and F and F' each independently represents a cyano radical, an ester radical, an acyl radical, a carbamoyl radical or an alkylsulfonyl radical;

(SG-3)

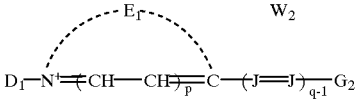

wherein $D_1$, $E_1$, J, p, q and $W_2$ are as defined above for formula (SD-1), and $G_2$ represents a substituted or unsubstituted amino radical or a substituted or unsubstituted aryl radical;

(SD-4)

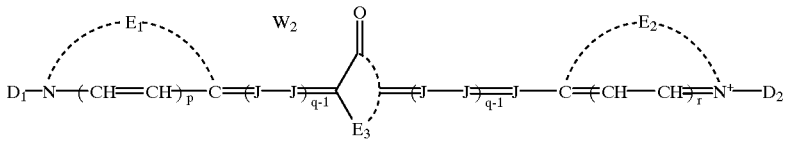

wherein $D_1$, $E_1$, $D_2$, $E_1$, J, p, q, r and $W_2$ are as defined for formula (SD-1) above, and $E_3$ is defined the same as $E_4$ for formula (SD-2) above;

(SD-5)

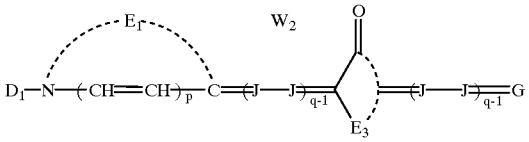

wherein $D_1$, $E_1$, J, G, p, q, r and $W_2$ are as defined above for formula (SD-1) above and $E_3$ is as defined for formula (SD-4) above.

In the above formulas, $E_1$ and $E_2$ each independently represents the atoms necessary to complete a substituted or unsubstituted 5- or 6-membered heterocyclic nucleus. These include a substituted or unsubstituted: thiazole nucleus, oxazole nucleus, selenazole nucleus, quinoline nucleus, tellurazole nucleus, pyridine nucleus, thiazoline nucleus, indoline nucleus, oxadiazole nucleus, thiadiazole nucleus, or imidazole nucleus. This nucleus may be substituted with known substituents, such as halogen (e.g., chloro, fluoro, bromo), alkoxy (e.g., methoxy, ethoxy), substituted or unsubstituted alkyl (e.g., methyl, trifluoromethyl), substituted or unsubstituted aryl, substituted or unsubstituted aralkyl, sulfonate, and others known in the art.

In one embodiment of the invention, when dyes according to formula (SD-1) are used $E_1$ and $E_2$ each independently represent the atoms necessary to complete a substituted or unsubstituted thiazole nucleus, a substituted or unsubstituted selenazole nucleus, a substituted or unsubstituted imidazole nucleus, or a substituted or unsubstituted oxazole nucleus.

Examples of useful nuclei for $E_1$ and $E_2$ include: a thiazole nucleus, e.g., thiazole, 4-methylthiazole, 4-phenylthiazole, 5-methylthiazole, 5-phenylthiazole, 4,5-dimethyl-thiazole, 4,5-diphenylthiazole, 4-(2-thienyl) thiazole, benzothiazole, 4-chlorobenzothiazole, 5-chlorobenzothiazole, 6-chlorobenzothiazole, 7-chlorobenzothiazole, 4-methylbenzothiazole, 5-methylbenzothiazole, 6-methylbenzothiazole, 5-bromobenzothiazole, 6-bromobenzothiazole, 5-phenylbenzothiazole, 6-phenylbenzothiazole, 4 -methoxybenzothiazole, 5-methoxybenzothiazole, 6-methoxybenzothiazole, 4-ethoxybenzothiazole, 5-ethoxybenzothiazole, tetrahydrobenzothiazole, 5,6-dimethoxybenzothiazole, 5,6-dioxymethylbenzothiazole, 5-hydroxybenzothiazole, 6-5-hydroxybenzothiazole, naphtho[2,1-d]thiazole, 5-ethoxynaphtho[2,3-d]thiazole, 8-methoxynaphtho[2,3-d]thiazole, 7-methoxynaphtho[2,3-d]thiazole, 4'-methoxythianaphtheno-7',6'-4,5-thiazole, etc.; an oxazole nucleus, e.g., 4-methyloxazole, 5-methyloxazole, 4-phenyloxazole, 4,5-diphenyloxazole, 4-ethyloxazole, 4,5-dimethyloxazole, 5-phenyloxazole, benzoxazole, 5-chlorobenzoxazole, 5-methylbenzoxazole, 5-phenylbenzoxazole, 6-methylbenzoxazole,, 5,6-dimethylbenzoxazole, 4,6-dimethylbenzoxazole, 5-ethoxybenzoxazole, 5-chlorobenzoxazole, 6-methoxybenzoxazole, 5-hydroxybenzoxazole, 6-hydroxybenzoxazole,, naphtho[2,1-d]oxazole, naphtho[1,2-d]oxazole, etc.; a selenazole nucleus, e.g., 4-methylselenazole, 4-phenylselenazole, benzoselenazole, 5-chlorobenzoselenazole, 5-methoxybenzoselenazole, 5-hydroxybenzoselenazole, tetrahydrobenzoselenazole, naphtho[2,1-d]selenazole, naphtho[1,2-d]selenazole, etc.; a pyridine nucleus, e.g., 2-pyridine, 5-methyl-2-pyridine, 4-pyridine, 3-methyl-4-pyridine, 3-methyl-4-pyridine, etc.; a quinoline nucleus, e.g., 2-quinoline, 3-methyl-2-quinoline, 5-ethyl-2-quinoline, 6-chloro-2-quinoline, 8-chloro-2-quinoline, 6-methoxy-2-quinoline, 8-ethoxy-2-quinoline, 8-hydroxy-2-quinoline, 4-quinoline, 6-methoxy-4-quinoline, 7-methyl-4-quinoline, 8-chloro-4-quinoline, etc.; a tellurazole nucleus, e.g., benzotellurazole, naphtho[1.2-d] benzotellurazole, 5,6-dimethoxybenzotellurazole, 5-methoxybenzotellurazole, 5-methylbenzotellurazole; a thiazoline nucleus, e.g., thiazoline, 4-methylthiazoline, etc.; a benzimidazole nucleus, e.g., benzimidazole, 5-trifluoromethylbenzimidazole, 5,6-dichlorobenzimidazole; and indole nucleus, 3,3-dimethylindole, 3,3-diethylindole, 3,3,5-trimethylindole; or a diazole nucleus, e.g., 5-phenyl-1,3,4-oxadiazole, 5-methyl-1,3,4-thiadiazole.

F and F' are each a cyano radical, an ester radical such as ethoxy carbonyl, methoxycarbonyl, etc., an acyl radical, a carbamoyl radical, or an alkylsulfonyl radical such as ethylsulfonyl, methylsulfonyl, etc. Examples of useful nuclei for $E_4$ include a 2-thio-2,4-oxazolidinedione nucleus (i.e., those of the 2-thio-2,4-(3H,5H)-oxaazolidinone series) (e.g., 3-ethyl-2-thio-2,4 oxazolidinedione, 3-(2-sulfoethyl)-2-thio-2,4 oxazolidinedione, 3-(4-sulfobutyl)-2-thio-2,4 oxazolidinedione, 3-(3-carboxypropyl)-2-thio-2,4 oxazolidinedione, etc.; a thianaphthenone nucleus (e.g., 2-(2H)-thianaphthenone, etc.), a 2-thio-2,5-thiazolidinedione nucleus (i.e., the 2-thio-2,5-(3H,4H)-thiazoledeione series) (e.g., 3-ethyl-2-thio-2,5-thiazolidinedione, etc.); a 2,4-thiazolidinedione nucleus (e.g., 2,4-thiazolidinedione, 3-ethyl-2,4-thiazolidinedione, 3-phenyl-2,4-thiazolidinedione, 3-α-naphthyl-2,4-thiazolidinedione, etc.); a thiazolidinone nucleus (e.g., 4-thiazolidinone, 3-ethyl-4-thiazolidinone, 3-phenyl-4-thiazolidinone, 3-α-naphthyl-4-thiazolidinone, etc.); a 2-thiazolin-4-one series (e.g., 2-ethylmercapto-2-thiazolin-4-one, 2-alkylphenyamino-2-thiazolin-4-one, 2-diphenylamino-2-thiazolin-4-one, etc.) a 2-imino-4-oxazolidinone (i.e., pseudohydantoin) series (e.g., 2,4-imidazolidinedione (hydantoin) series (e.g., 2,4-imidazolidinedione, 3-ethyl-2,4-imidazolidinedione, 3-phenyl-2,4-imidazolidinedione, 3-α-naphthyl-2,4-imidazolidinedione, 1,3-diethyl-2,4-imidazolidinedione, 1-ethyl-3-phenyl-2,4-imidazolidinedione, 1-ethyl-2-α-naphthyl-2,4-imidazolidinedione, 1,3-diphenyl-2,4-imidazolidinedione, etc.); a 2-thio-2,4-imidazolidinedione (i.e., 2-thiohydantoin) nucleus (e.g., 2-thio-2,4-imidazolidinedione, 3-ethyl-2-thio-2,4-imidazolidinedione, 3-(2-carboxyethyl)-2-thio-2,4-imidazolidinedione, 3-phenyl-2-thio-2,4-imidazolidinedione, 1,3-diethyl-2-thio-2,4-imidazolidinedione, 1-ethyl-3-phenyl-2-thio-2,4-imidazolidinedione, 1-ethyl-3-naphthyl-2-thio-2,4-imidazolidinedione, 1,3-diphenyl-2-thio-2,4-imidazolidinedione, etc.); a 2-imidazolin-5-one nucleus.

$G_2$ represents a substituted or unsubstituted amino radical (e.g., primary amino, anilino), or a substituted or unsubstituted aryl radical (e.g., phenyl, naphthyl, dialkylaminophenyl, tolyl, chlorophenyl, nitrophenyl).

According to the formulas (SD-1)–(SD-5), each J represents a substituted or unsubstituted methine group. Examples of substituents for the methine groups include alkyl (preferably of from 1 to 6 carbon atoms, e.g., methyl, ethyl, etc.) and aryl (e.g., phenyl). Additionally, substituents on the methine groups may form bridged linkages.

$W_2$ represents a counterion as necessary to balance the charge of the dye molecule. Such counterions include cations and anions for example sodium, potassium, triethylammonium, tetramethylguanidinium, diisopropylanunonium, tetrabutylammonium, chloride, bromide, iodide, para-toluene sulfonate and the like.

$D_1$ and $D_2$ are each independently substituted or unsubstituted aryl (preferably of 6 to 15 carbon atoms), or more preferably, substituted or unsubstituted alkyl (preferably of from 1 to 6 carbon atoms). Examples of aryl include phenyl, tolyl, p-chlorophenyl, and p-methoxyphenyl. Examples of alkyl include methyl, ethyl, propyl, isopropyl, butyl, hexyl, cyclohexyl, decyl, dodecyl, etc., and substituted alkyl groups (preferably a substituted lower alkyl containing from 1 to 6 carbon atoms), such as a hydroxyalkyl group, e.g., 2-hydroxyethyl, 4-hydroxybutyl, etc., a carboxyalkyl group, e.g., 2-carboxyethyl, 4-carboxybutyl, etc., a sulfoalkyl group, e.g., 2-sulfoethyl, 3-sulfobutyl, 4-sulfobutyl, etc., a sulfatoalkyl group, etc., an acyloxyalkyl group, e.g., 2-acetoxyethyl, 3-acetoxypropyl, 4-butyroxybutyl, etc., an alkoxycarbonlyalkyl group, e.g., 2-methoxycarbonlyethyl, 4-ethoxycarbonylbutyl, etc.,or an aralkyl group, e.g., benzyl, phenethyl, etc., The alkyl or aryl group may be substituted by one or more of the substituents on the above-described substituted alkyl groups.

Although epitaxy onto the host tabular grains can itself act as a sensitizer, the emulsions of the invention show sensitivity enhancements with or without epitaxy when chemically sensitized employing one or a combination of noble metal, middle chalcogen (sulfur, selenium and/or tellurium) and reduction chemical sensitization techniques. Conventional chemical sensitizations by these techniques are summarized in *Research Disclosure*, Item 38957, cited above, Section IV. Chemical sensitizations. It is preferred to employ at least one of noble metal (typically gold) and middle chalcogen (typically sulfur) and, most preferably, a combination of both in preparing the emulsions of the invention for photographic use.

A specifically preferred-approach to chemical sensitization employs a combination of sulfur containing ripening agents in combination with middle chalcogen (typically sulfur) and noble metal (typically gold) chemical sensitizers. Contemplated sulfur containing ripening agents include thioethers, such as the thioethers illustrated by McBride U.S. Pat. No. 3,271,157, Jones U.S. Pat. No. 3,574,628 and Rosencrants et al U.S. Pat. No. 3,737,313. Preferred sulfur containing ripening agents are thiocyanates, illustrated by Nietz et al U.S. Pat. No. 2,222,264, Lowe et al U.S. Pat. No. 2,448,534 and Illingsworth U.S. Pat. No. 3,320,069. A preferred class of middle chalcogen sensitizers are tetra-substituted middle chalcogen ureas of the type disclosed by Herz et al U.S. Pat. Nos. 4,749,646 and 4,810,626, the disclosures of which are here incorporated by reference. Preferred compounds include those represented by the formula:

(Cpd. 1)

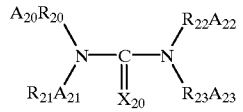

wherein $X_{20}$ is sulfur, selenium or tellurium;

each of $R_{20}$, $R_{21}$, $R_{22}$ and $R_{23}$ can independently represent an alkylene, cycloalkylene, alkarylene, aralkylene or heterocyclic arylene group or, taken together with the nitrogen atom to which they are attached, $R_{20}$ and $R_{21}$ or $R_{22}$ and $R_{23}$ complete a 5 to 7 member heterocyclic ring; and each of $A_{21}$, $A_{21}$, $A_{22}$ and $A_{23}$ can independently represent hydrogen or a radical comprising an acidic group, with the proviso that at least one $A_{20}R_{21}$ to $A_{22}R_{23}$ contains an acidic group bonded to the urea nitrogen through a carbon chain containing from 1 to 6 carbon atoms.

$X_{20}$ is preferably sulfur and $A_{20}R_{21}$ to $A_{22}R_{24}$ are preferably methyl or carboxymethyl, where the carboxy group can be in the acid or salt form. A specifically preferred tetra substituted thiourea sensitizer is 1,3-dicarboxymethyl-1,3-dimethylthiourea.

Preferred gold sensitizers are the gold(I) compounds disclosed by Deaton U.S. Pat. No. 5,049,485, the disclosure of which is here incorporated by reference. These compounds include those represented by the formula:

(Cpd. 2)

$$AuL''_2{}^+X_2{}^- \text{ or } AuL''(L^1)^+X_2{}^-$$

wherein

L" is a mesoionic compound;

$X_2$ is an anion; and $L^1$ is a Lewis acid donor.

In accordance with this invention the silver halide emulsion containing epitaxially sensitized silver halide grains further contains a fragmentable electron donating (FED) compound which enhances the sensitivity of the emulsion. The fragmentable electron donating compound is of the formula X—Y' or a compound which contains a moiety of the formula —X—Y';

wherein

X is an electron donor moiety, Y' is a leaving proton H or a leaving group Y, with the proviso that if Y' is a proton, a base, $\beta^-$, is covalently linked directly or indirectly to X, and wherein:

1) X—Y' has an oxidation potential between 0 and about 1.4 V; and 2) the oxidized form of X—Y' undergoes a bond cleavage reaction to give the radical $X^{\bullet}$ and the leaving fragment Y';

and, optionally, 3) the radical $X^{\bullet}$ has an oxidation potential $\leqq -0.7V$ (that is, equal to or more negative than about −0.7V).

Compounds wherein X—Y' meets criteria (1) and (2) but not (3) are capable of donating one electron and are referred to herein as fragmentable one-electron donating compounds. Compounds which meet all three criteria are capable of donating two electrons and are referred to herein as fragmentable two-electron donating compounds.

In this patent application, oxidation potentials are reported as "V" which represents "volts versus a saturated calomel reference electrode".

In embodiments of the invention in which Y' is Y, the following represents the reactions that are believed to take place when X—Y undergoes oxidation and fragmentation to produce a radical $Y^{\bullet}$, which in a preferred embodiment undergoes further oxidation.

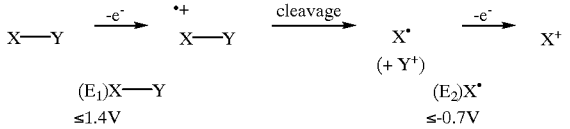

where $E_1$ is the oxidation potential of X—Y and $E_2$ is the oxidation potential of the radical $X^{\bullet}$.

$E_1$ is preferably no higher than about 1.4 V and preferably less than about 1.0 V. The oxidation potential is preferably greater than 0, more preferably greater than about 0.3 V. $E_1$ is preferably in the range of about 0 to about 1.4 V, and more preferably from about 0.3 V to about 1.0 V.

In certain embodiments of the invention the oxidation potential, $E_2$, of the radical $X^{\bullet}$ is equal to or more negative than −0.7V, preferably more negative than about −0.9 V. $E_2$ is preferably in the range of from about −0.7 to about −2 V, more preferably from about −0.8 to about −2 V and most preferably from about −0.9 to about −1.6 V.

The structural features of X—Y are defined by the characteristics of the two parts, namely the fragment X and the fragment Y. The structural features of the fragment X determine the oxidation potential of the X—Y molecule and that of the radical $X^{\bullet}$, whereas both the X and Y fragments affect the fragmentation rate of the oxidized molecule $X—Y^{\bullet+}$.

In embodiments of the invention in which Y' is H, the following represents the reactions believed to take place when the compound X—H undergoes oxidation and deprotonation to the base, $\beta^-$, to produce a radical $Y^{\bullet}$, which in a preferred embodiment undergoes further oxidation.

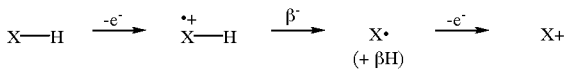

Preferred X groups are of the general formula:

(I)

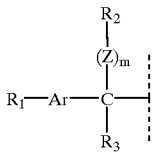

(II)

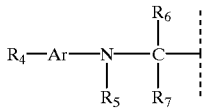

-continued (III)

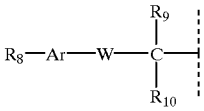

or (IV)

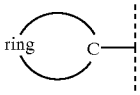

The symbol "R" (that is R without a subscript) is used in all structural formulae in this patent application to represent a hydrogen atom or an unsubstituted or substituted alkyl group.

In structure (I):

m=0, 1;

Z=O, S, Se, Te;

Ar=aryl group (e.g., phenyl, naphthyl, phenanthryl, anthryl); or heterocyclic group (e.g., pyridine, indole, benzimidazole, thiazole, benzothiazole, thiadiazole, etc.);

$R_1$=R, carboxyl, amide, sulfonamide, halogen, $NR_2$, $(OH)_n$, $(OR')_n$, or $(SR)_n$;

R'=alkyl or substituted alkyl;

n=1–3;

$R_2$=R, Ar';

$R_3$=R, Ar';

$R_2$ and $R_3$ together can form 5- to 8-membered ring;

$R_2$ and Ar=can be linked to form 5- to 8-membered ring;

$R_3$ and Ar=can be linked to forms 5- to 8-membered ring;

Ar'=aryl group such as phenyl, substituted phenyl, or heterocyclic group (e.g., pyridine, benzothiazole, etc.)

R=a hydrogen atom or an unsubstituted or substituted alkyl group.

In structure (II):

Ar=aryl group (e.g., phenyl, naphthyl, phenanthryl); or heterocyclic group (e.g., pyridine, benzothiazole, etc.);

$R_4$=a substituent having a Hammett sigma value of −1 to +1, preferably −0.7 to +0.7, e.g., R, OR, SR, halogen, CHO, C(O)R, COOR, $CONR_2$, $SO_3R$, $SO_2NR_2$, $SO_2R$, SOR, C(S)R, etc;

$R_5$=R, Ar'

$R_6$ and $R_7$=R, Ar'

$R_5$ and Ar=can be linked to form 5- to 8-membered ring;

$R_6$ and Ar=can be linked to form 5- to 8-membered ring (in which case, $R_6$ can be a hetero atom);

$R_5$ and $R_6$ can be linked to form 5- to 8-membered ring;

$R_6$ and $R_7$ can be linked to form 5- to 8-membered ring;

Ar'=aryl group such as phenyl, substituted phenyl, heterocyclic group;

R=hydrogen atom or an unsubstituted or substituted alkyl group.

A discussion on Hammett sigma values can be found in C. Hansch and R. W. Taft *Chem. Rev.* Vol 91, (1991) p 165, the disclosure of which is incorporated herein by reference.

In structure (III):

W=O, S, Se;

Ar=aryl group (e.g., phenyl, naphthyl, phenanthryl, anthryl); or heterocyclic group (e.g., indole, benzimidazole, etc.)

$R_8$=R, carboxyl, $NR_2$, $(OR)_n$, or $(SR)_n$ (n=1–3);

$R_9$ and $R_{10}$=R, Ar';

$R_9$ and Ar=can be linked to form 5- to 8-membered ring;

Ar'=aryl group such as phenyl substituted phenyl or heterocyclic group;

R=a hydrogen atom or an unsubstituted or substituted alkyl group.

In structure (IV):

"ring" represents a substituted or unsubstituted 5-, 6- or 7-membered unsaturated ring, preferably a heterocyclic ring.

The following are illustrative examples of the group X of the general structure I:

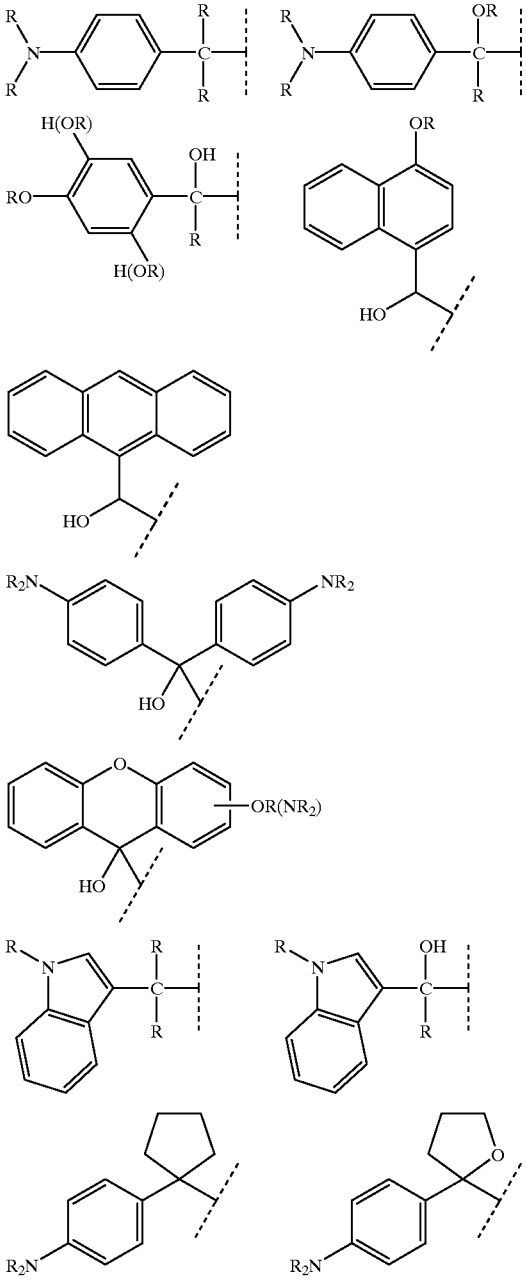

-continued

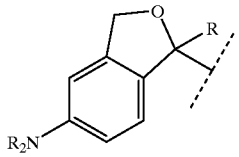

In the structures of this patent application a designation such as —OR($NR_2$) indicates that either —OR or —$NR_2$ can be present.

The following are illustrative examples of the group X of general structure II:

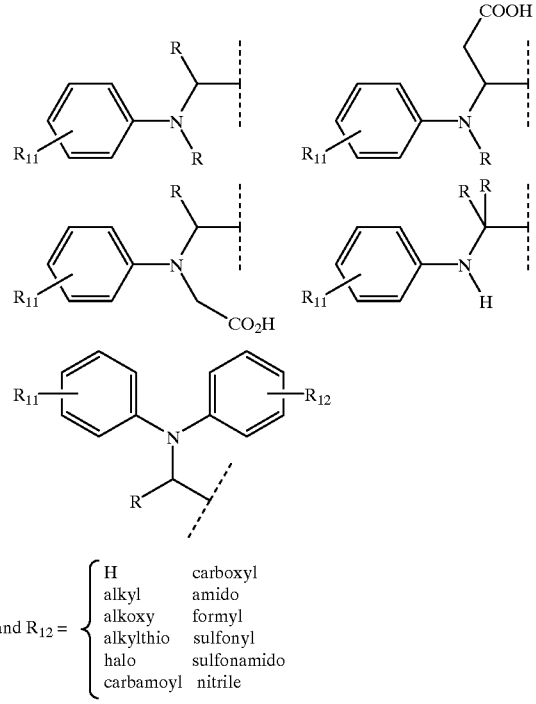

$R_{11}$ and $R_{12}$ = { H, alkyl, alkoxy, alkylthio, halo, carbamoyl; carboxyl, amido, formyl, sulfonyl, sulfonamido, nitrile }

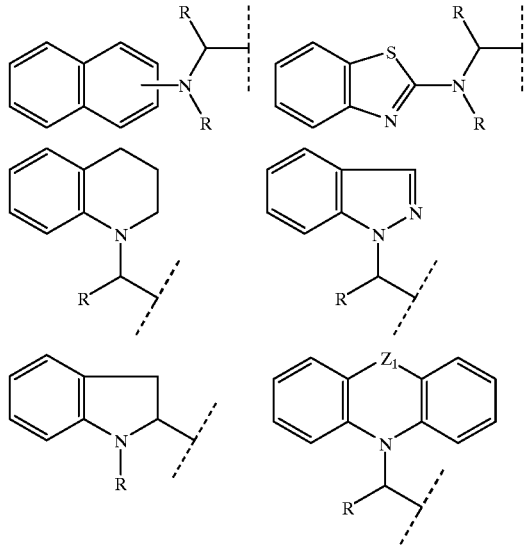

$Z_1$=a covalent bond, S, O, Se, NR, $CR_2$, CR=CR, or $CH_2CH_2$.

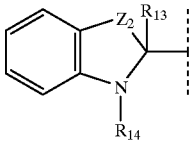

$Z_2$=S, O, Se, NR, $CR_2$, CR═CR, $R_{13}$,=alkyl, substituted alkyl or aryl, and $R_{14}$=H, alkyl substituted alkyl or aryl.

The following are illustrative examples of the group X of the general structure III:

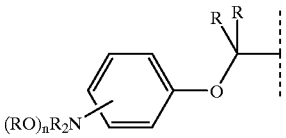

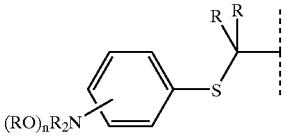

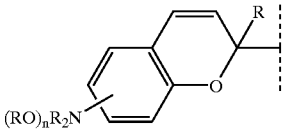

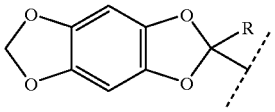

n=1–3

The following are illustrative examples of the group X of the general structure IV:

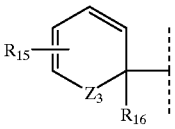

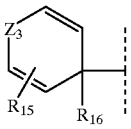

-continued

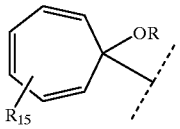

$Z_3$=O, S, Se, NR
$R_{15}$=R, OR, $NR_2$
$R_{16}$=alkyl, substituted alkyl
Preferred Y' groups are:

(1)

X', where X' is an X group as defined in structures I–IV and may be the same as or different from the X group to which it is attached (2)

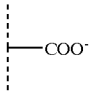

(3)

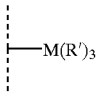

where M = Si, Sn or Ge; and R' = alkyl or substituted alkyl (4)

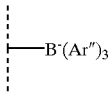

where Ar'' = aryl or substituted aryl (5)

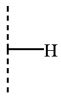

In preferred embodiments of this invention Y' is —H, —$COO^-$ or —$Si(R')_3$ or —X'. Particularly preferred Y' groups are —H, —COO– or —$Si(R')_3$.

In embodiments of the invention in which Y' is a proton, a base, $\beta^-$, is covalently linked directly or indirectly to X. The base is preferably the conjugate base of an acid of pKa between about 1 and about 8, preferably about 2 to about 7. Collections of pKa values are available (see, for example: Dissociation Constants of Organic Bases in Aqueous Solution, D. D. Perrin (Butterworths, London, 1965); CRC Handbook of Chemistry and Physics, 77th ed, D. R. Lide (CRC Press, Boca Raton, Fla., 1996)). Examples of useful bases are included in Table I.

TABLE I

| pKa's in water of the conjugate acids of some useful bases | | | |
|---|---|---|---|
| $CH_3$—$CO_2^-$ | 4.76 | $CH_3$—$COS^-$ | 3.33 |
| $C_2H_5$—$CO_2^-$ | 4.87 | 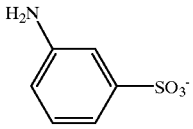 | 3.73 |

TABLE I-continued

| pKa's in water of the conjugate acids of some useful bases | | | |
|---|---|---|---|
| $(CH_3)_2CH—CO_2^-$ | 4.84 | 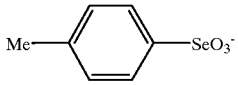 | 4.88 |
| $(CH_3)_3C—CO_2^-$ | 5.03 | 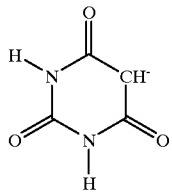 | 4.01 |
| $HO—CH_2—CO_2^-$ | 3.83 | 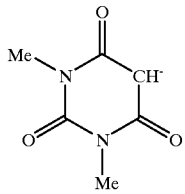 | 4.7 |
| 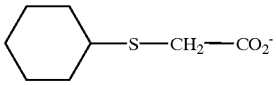 | 3.48 | $(CH_3)_3\overset{+}{N}—\overset{-}{O}$ | 4.65 |
| $CH_3—CO—NH—CH_2—CO_2^-$ | 3.67 | $H_2N—CH_2—CH(CH_3)—\overset{+}{N}H_3$ | 6.61 |
| 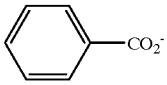 | 4.19 | 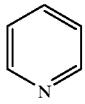 | 5.25 |
| 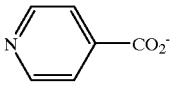 | 4.96 | 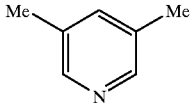 | 6.15 |
| | | 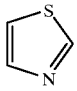 | 2.44 |
| | | 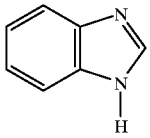 | 5.53 |

Preferably the base, $\beta^-$ is a carboxylate, sulfate or amine oxide.

In some embodiments of the invention, the fragmentable electron donating compound contains a light absorbing group, Z, which is attached directly or indirectly to X, a silver halide absoxptive group, A, directly or indirectly attached to X, or a chromophore forming group, Q, which is attached to X. Such fragmentable electron donating compounds are preferably of the following formulae:

$Z—(L—X—Y')_k$ $A—(L—X—Y')_k$ $(A—L)_k—X—Y'$ $Q—X—Y'$ $A—(X—Y')_k$ $(A)_k—X—Y'$ $Z—(X—Y')_k$ or $(Z)_k$—X—Y'

Z is a light absorbing group;

k is 1 or2;

A is a silver halide adsorptive group that preferably contains at least one atom of N, S, P, Se, or Te that promotes adsorption to silver halide;

L represents a linking group containing at least one C, N, S, P or O atom; and

Q represents the atoms necessary to form a chromophore comprising an amidinium-ion, a carboxyl-ion or dipolar-amidic chromophoric system when conjugated with X—Y'.

Z is a light absorbing group including, for example, cyanine dyes, complex cyanine dyes, merocyanine dyes, complex merocyanine dyes, homopolar cyanine dyes, styryl dyes, oxonol dyes, hemioxonol dyes, and hemicyanine dyes.

Preferred Z groups are derived from the following dyes:

Dye 1

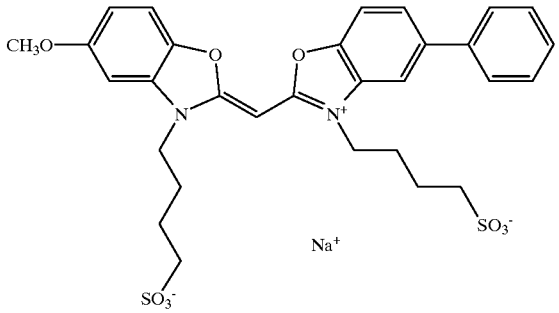

Dye 2

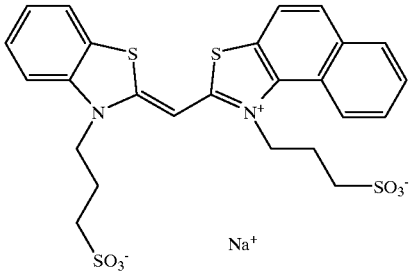

Dye 3

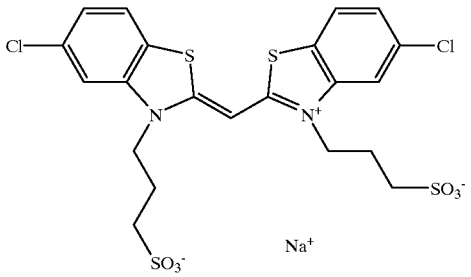

-continued

Dye 4

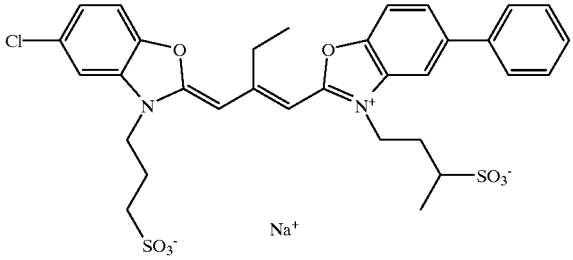

Dye 5

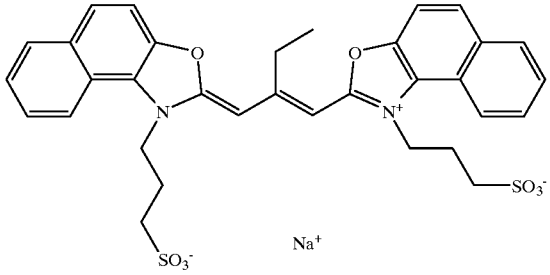

Dye 6

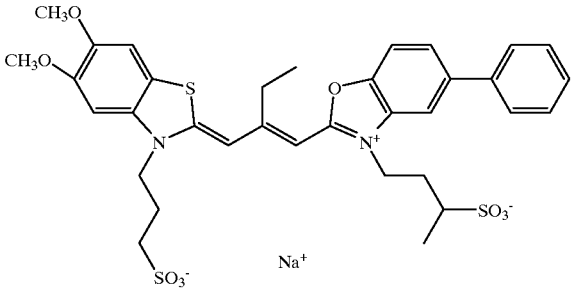

Dye 7

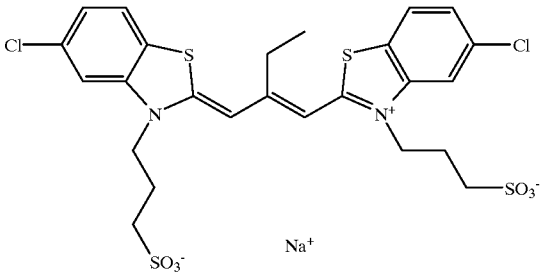

and

Dye 8

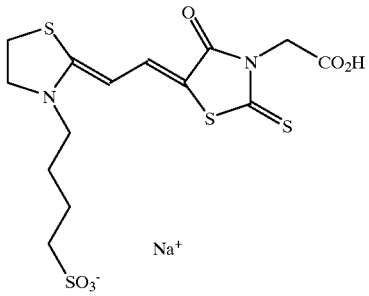

The linking group L may be attached to the dye at one (or more) of the heteroatoms, at one (or more) of the aromatic or heterocyclic rings, or at one (or more) of the atoms of the polymethine chain, at one (or more) of the heteroatoms, at one (or more) of the aromatic or heterocyclic rings, or at one (or more) of the atoms of the polymethine chain. For simplicity, and because of the multiple possible attachment sites, the attachment of the L group is not specifically indicated in the generic structures.

The silver halide adsorptive group A is preferably a silver-ion ligand moiety or a cationic surfactant moiety. In preferred embodiments, A is selected from the group consisting of: i) sulfur acids and their Se and Te analogs, ii) nitrogen acids, iii) thioethers and their Se and Te analogs, iv) phosphines, v) thionamides, selenamides, and telluramides, and vi) carbon acids.

Illustrative A groups include:

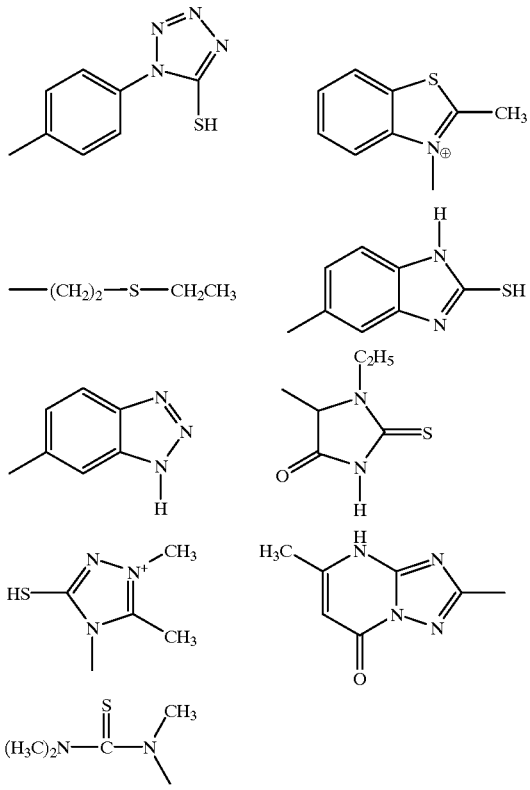

The point of attachment of the linking group L to the silver halide adsorptive group A will vary depending on the structure of the adsorptive group, and may be at one (or more) of the heteroatoms, at one (or more) of the aromatic or heterocyclic rings.

The linkage group represented by L which connects by a covalent bond the light absorbing group Z or the silver halide adsorbing group A to the fragmentable electron donating group XY is preferably an organic linking group containing a least one C, N, S, or O atom. It is also desired that the linking group not be completely aromatic or unsaturated, so that a pi-conjugation system cannot exist between the Z and XY or the A and XY moieties. Preferred examples of the linkage group include, an alkylene group, an arylene group, —O—, —S—, —C═O, —$SO_2$—, —NH—, —P═O, and —N═. Each of these linking components can be optionally substituted and can be used alone or in combination. Examples of preferred combinations of these groups are:

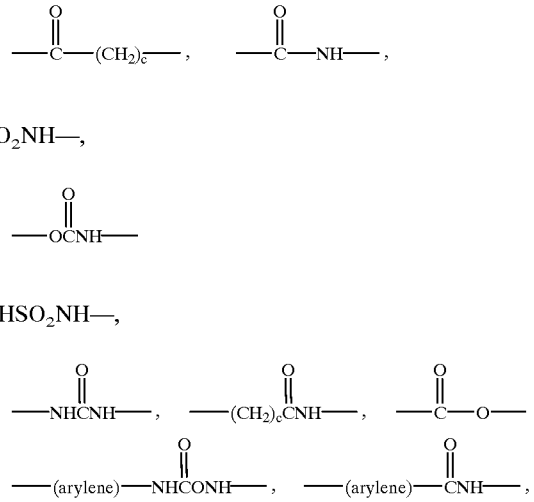

—$SO_2$NH—,

—NH$SO_2$NH—,

—$(OCH_2CH_2)_d$— where c=1–30, and d=1–10

The length of the linkage group can be limited to a single atom or can be much longer, for instance up to 30 atoms in length. A preferred length is from about 2 to 20 atoms, and most preferred is 3 to 10 atoms. Some preferred examples of L can be represented by the general formulae indicated below:

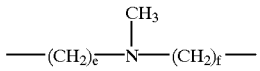

—$(CH_2)_e$—$SO_2$—NH—$(CH_2)_f$— —$(CH_2)_e$—O—$(CH_2)_f$—
—$(CH_2)_e$—CO—NH—$(CH_2)_f$—

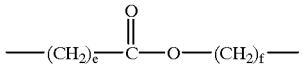

—$(CH_2)_e$— e and f=1–30, with the proviso that e+f≦31.

Q represents the atoms necessary to form a chromophore comprising an amidinium-ion, a carboxyl-ion or dipolar-amidic chromophoric system when conjugated with X—Y'. Preferably the chromophoric system is of the type generally found in cyanine, complex cyanine, hemicyanine, merocyanine, and complex merocyanine dyes as described in F. M. Hamer, *The Cyanine Dyes and Related Compounds* (Interscience Publishers, New York, 1964).

Illustrative Q groups includes:

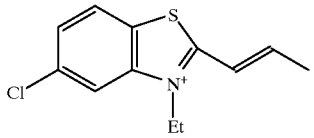

-continued

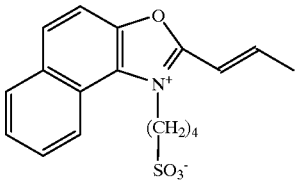

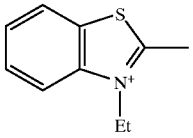

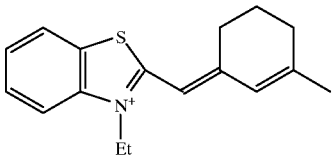

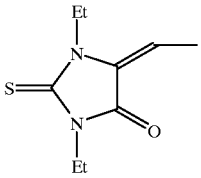

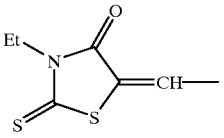

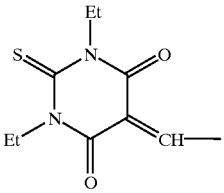

-continued

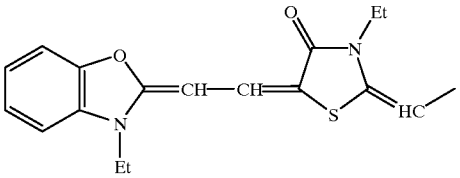

Particularly preferred are Q groups of the formula:

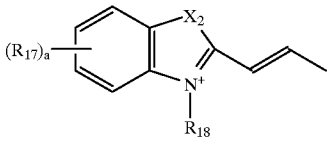

wherein:

$X_2$ is O, S, N, or $C(R_{19})_2$, where $R_{19}$ is substituted or unsubstituted alkyl.

each $R_{17}$ is independently a hydrogen atom, a halogen atom, a substituted or unsubstituted alkyl group, or substituted or unsubstituted aryl group;

a is an integer of 1–4; and $R_{18}$ is substituted or unsubstituted alkyl, or substituted or unsubstituted aryl.

Illustrative fragmentable electron donating compounds include:

FED 1

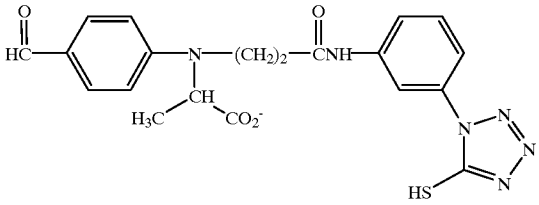

FED 2

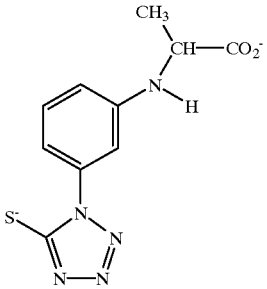

FED 3

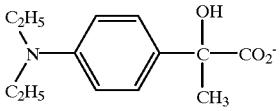

FED 4

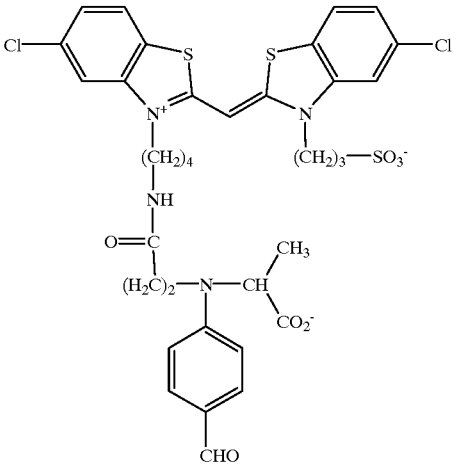

-continued
FED 5
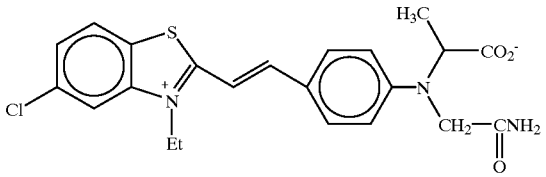
FED 6
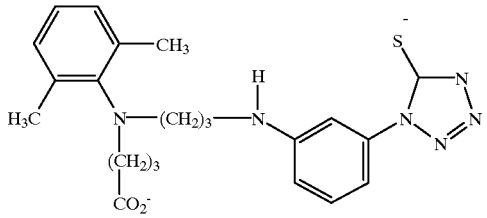
FED 7
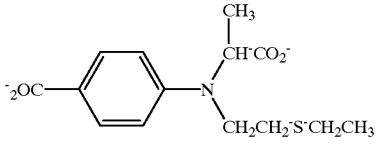
FED 8
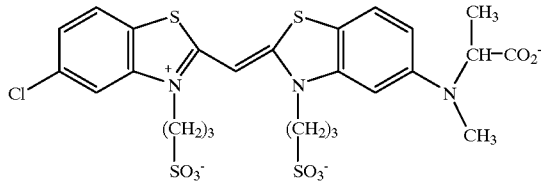
FED 9
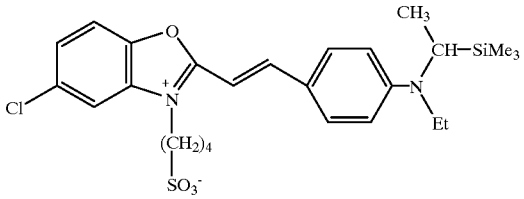
FED 10
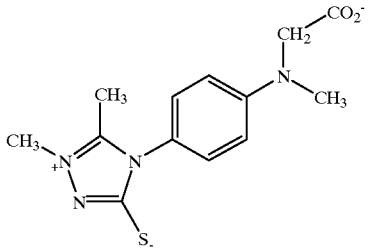
FED 11
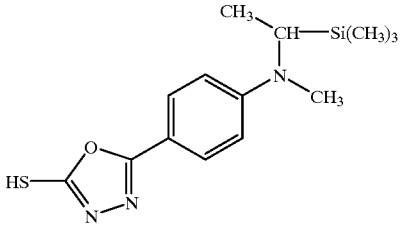
FED 12
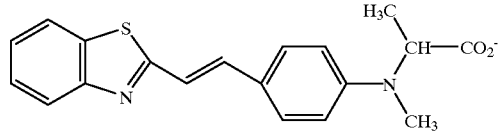
FED 13
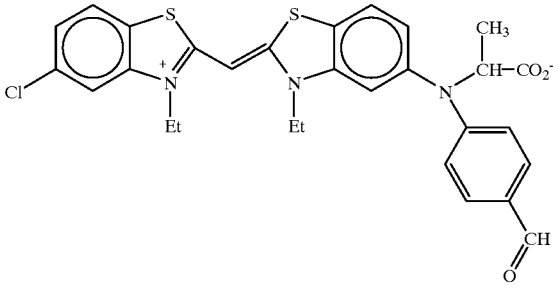
FED 14
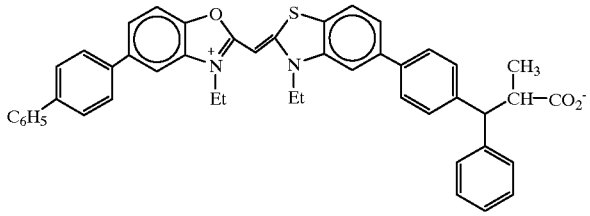

-continued

FED 15

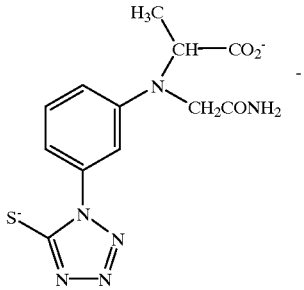

FED 16

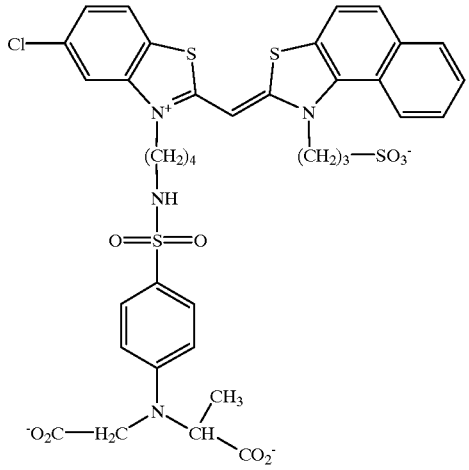

FED 17

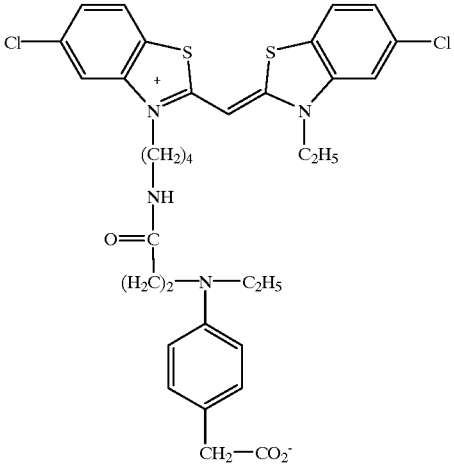

FED 18

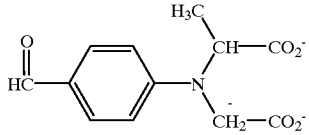

FED 18

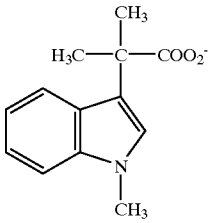

FED 20

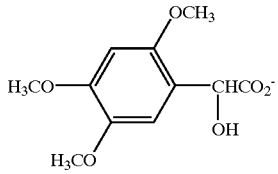

FED 21

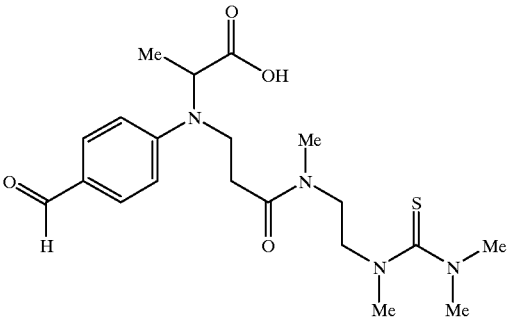

FED 22

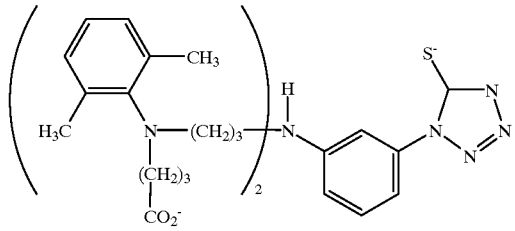

The fragmentable electron donors of the present invention can be included in a silver halide emulsion by direct dispersion in the emulsion, or they may be dissolved in a solvent such as water, methanol or ethanol for example, or in a mixture of such solvents, and the resulting solution can be added to the emulsion. The compounds of the present invention may also be added from solutions containing a base and/or surfactants, or may be incorporated into aqueous slurries or gelatin dispersions and then added to the emulsion. The fragmentable electron donor may be used as the sole sensitizer in the emulsion. However, in preferred embodiments of the invention a sensitizing dye is also added to the emulsion. The compounds can be added before, during or after the addition of the sensitizing dye. The amount of electron donor which is employed in this invention may range from as little as $1\times10^{-8}$ mole per mole of silver in the emulsion to as much as about 0.1 mole per mole of silver, preferably from about $5\times10^{-7}$ to about 0.05 mole per mole of silver. Where the oxidation potential $E_1$ for the XY moiety of the electron donating sensitizer is a relatively low potential, it is more active, and relatively less agent need be employed. Conversely, where the oxidation potential for the XY moiety of the electron donating sensitizer is relatively high, a larger amount thereof, per mole of silver, is employed. In addition, for XY moieties that have silver halide adsorptive groups A or light absorptive groups Z or chromophoric groups Q directly or indirectly attached to X, the fragmentable electron donating sensitizer is more closely associated with the silver halide grain and relatively less agent need be employed. For fragmentable one-electron donors relatively larger amounts per mole of silver are also employed. Although it is preferred that the fragmentable electron donor be added to the silver halide emulsion prior to manufacture of the coating, in certain instances, the electron donor can also be incorporated into the emulsion after exposure by way of a pre-developer bath or by way of the developer bath itself.

Fragmentable electron donating compounds are described more fully in U.S. Pat. Nos. 5,747,235 and 5,747,236 and commonly assigned co-pending U.S. applications Ser. No. 08/739,911 filed Oct. 30, 1996, and Ser. Nos. 091118,536, 09/118,552 and 09/118,714 filed Jul. 25, 1998, the entire disclosures of these patents and patent applications are incorporated herein by reference.

Various compounds may be added to the photographic material of the present invention for the purpose of lowering the fogging of the material during manufacture, storage, or processing. Typical antifoggants are discussed in Section VI of Research Disclosure I, for example tetraazaindenes, mercaptotetrazoles, polyhydroxybenzenes, hydroxyaminobenzenes, combinations of a thiosulfonate and a sulfinate, and the like.

For this invention, polyhydroxybenzene and hydroxyaminobenzene compounds (hereinafter "hydroxybenzene compounds") are preferred as they are effective for lowering fog without decreasing the emulsion sensitvity. Examples of hydroxybenzene compounds are:

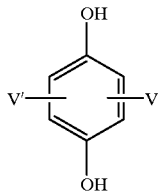

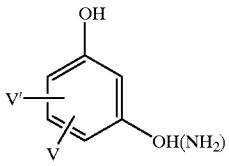

-continued

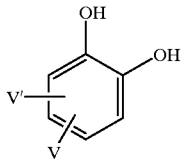

In these formulae, V and V' each independently represent —H, —OH, a halogen atom, —OM (M is alkali metal ion), an alkyl group, a phenyl group, an amino group, a carbonyl group, a sulfone group, a sulfonated phenyl group, a sulfonated alkyl group, a sulfonated amino group, a carboxyphenyl group, a carboxyalkyl group, a carboxyamino group, a hydroxyphenyl group, a hydroxyalkyl group, an alkylether group, an alkylphenyl group, an alkylthioether group, or a phenylthioether group.

More preferably, they each independently represent —H, —OH, —Cl, —Br, —COOH, $—CH_2CH_2COOH$, $—CH_3$, $—CH_2CH_3$, $—C(CH_3)_3$, $—OCH_3$, —CHO, $—SO_3K$, $—SO_3Na$, $—SO_3H$, $—SCH_3$, or -phenyl.

Especially preferred hydroxybenzene compounds follow:

HB1

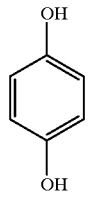

HB2

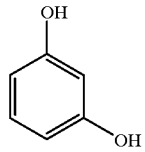

HB3

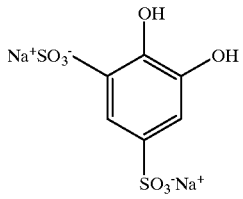

HB4

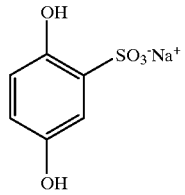

HB5

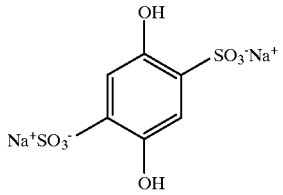

-continued

HB6

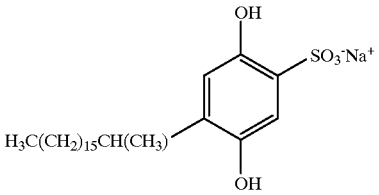

HB7

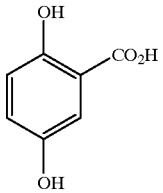

HB8

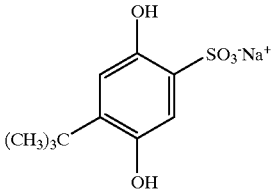

HB9

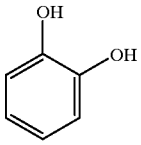

HB10

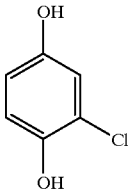

HB11

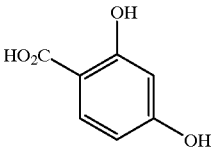

HB12

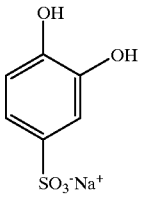

HB13

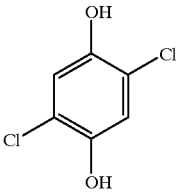

-continued

HB14

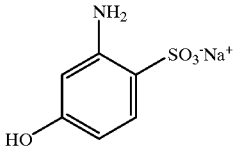

HB15

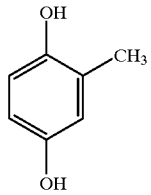

Hydroxybenzene compounds may be added to the emulsion layers or any other layers constituting the photographic material of the present invention. The preferred amount added is from $1\times10^{-3}$ to $1\times10^{-1}$ mol, and more preferred is $1\times\times10^{-3}$ to $2\times10^{-2}$ mol, per mol of silver halide.

Photographic elements of the present invention may also usefully include a magnetic recording material as described in *Research Disclosure,* Item 34390, November 1992, or a transparent magnetic recording layer such as a layer containing magnetic particles on the underside of a transparent support as in U.S. Pat. Nos. 4,279,945 and 4,302,523. The element typically will have a total thickness (excluding the support) of from 5 to 30 micrometers ($\mu$m). While the order of the color sensitive layers can be varied, they will normally be red-sensitive, green-sensitive and blue-sensitive, in that order on a transparent support, (that is, blue sensitive furthest from the support).

The present invention also contemplates the use of photographic elements of the present invention in what are often referred to as single use cameras (or "film with lens" units). Single use cameras are well known and typically comprise (1) a plastic inner camera shell including a taking lens, a film metering mechanism, and a simple shutter and (2) a paper-cardboard outer sealed pack which contains the inner camera shell and has respective openings for the taking lens and for a shutter release button, a frame counter window, and a film advance thumbwheel on the camera shell. The camera may also have a flash unit to provide light when the picture is taken. The inner camera shell has front and rear viewfinder windows located at opposite ends of a see-through viewfinder tunnel, and the outer sealed pack has front and rear openings for the respective viewfinder windows. At the manufacturer, the inner camera shell is loaded with a film cartridge, and substantially the entire length of the unexposed filmstrip is factory prewound from the cartridge into a supply chamber of the camera shell. After the customer takes a picture, the thumbwheel is manually rotated to rewind the exposed frame into the cartridge. The rewinding movement of the filmstrip the equivalent of one frame rotates a metering sprocket to decrement a frame counter to its next lower numbered setting. When substantially the entire length of the filmstrip is exposed and rewound into the cartridge, the single-use camera is sent to a photofinisher who first removes the inner camera shell from the outer sealed pack and then removes the filmstrip from the camera shell. The filmstrip is processed, and the camera shell and the opened pack are thrown away.

In the following discussion of suitable materials for use in elements of this invention, reference will be made to *Research Disclosure,* September 1996, Number 389, Item 38957, which will be identified hereafter by the term "Research Disclosure I." The Sections hereafter referred to are Sections of the Research Disclosure I unless otherwise indicated. The foregoing references and all other references cited in this application are incorporated herein by reference.

The silver halide emulsions employed in the photographic elements of the present invention may be negative-working, such as surface-sensitive emulsions or unfogged internal latent image forming emulsions, or positive working emulsions of the internal latent image forming type (that are fogged during processing). Suitable emulsions and their preparation as well as methods of chemical and spectral sensitization are described in Sections I through V. Color materials and development modifiers are described in Sections V through XX. In particular image dye-forming couplers are described in Section X, paragraph B. Vehicles which can be used in the photographic elements are described in Section II, and various additives such as brighteners, antifoggants, stabilizers, light absorbing and scattering materials, hardeners, coating aids, plasticizers, lubricants and matting agents are described, for example, in Sections VI through XIII. Manufacturing methods are described in all of the sections, layer arrangements particularly in Section XI, exposure alternatives in Section XVI, and processing methods and agents in Sections XIX and XX.

With negative working silver halide a negative image can be formed. Optionally a positive (or reversal) image can be formed although a negative image is typically first formed.

The photographic elements of the present invention may also use colored couplers (e.g. to adjust levels of interlayer correction) and masking couplers such as those described in EP 213 490; Japanese Published Application 58-172,647; U.S. Pat. No. 2,983,608; German Application DE 2,706,117C; U.K. Patent 1,530,272; Japanese Application A-113935; U.S. Pat. No. 4,070,191 and German Application DE 2,643,965. The masking couplers may be shifted or blocked.

The photographic elements may also contain materials that accelerate or otherwise modify the processing steps of bleaching or fixing to improve the quality of the image. Bleach accelerators described in EP 193 389; EP 301 477; U.S. Pat. Nos. 4,163,669; 4,865,956; and 4,923,784 are particularly useful. Also contemplated is the use of nucleating agents, development accelerators or their precursors (UK Patent 2,097,140; U.K. Patent 2,131,188); development inhibitors and their precursors (U.S. Pat. Nos. 5,460,932; 5,478,711); electron transfer agents (U.S. Pat. Nos. 4,859,578; 4,912,025); antifogging and anti color-mixing agents such as derivatives of hydroquinones, aminophenols, amines, gallic acid; catechol; ascorbic acid; hydrazides; sulfonamidophenols; and non color-forming couplers.

The elements may also contain filter dye layers comprising colloidal silver sol or yellow and/or magenta filter dyes and/or antihalation dyes (particularly in an undercoat beneath all light sensitive layers or in the side of the support opposite that on which all light sensitive layers are located) either as oil-in-water dispersions, latex dispersions or as solid particle dispersions. Additionally, they may be used with "smearing" couplers (e.g. as described in U.S. Pat. No. 4,366,237; EP 096 570; U.S. Pat. Nos. 4,420,556; and 4,543,323.) Also, the couplers may be blocked or coated in protected form as described, for example, in Japanese Application 61/258,249 or U.S. Pat. No. 5,019,492.

The photographic elements may further contain other image-modifying compounds such as "Development Inhibitor-Releasing" compounds (DIR's). Useful additional DIR's for elements of the present invention, are known in the art and examples are described in U.S. Pat. Nos. 3,137,578; 3,148,022; 3,148,062; 3,227,554; 3,384,657; 3,379,529; 3,615,506; 3,617,291; 3,620,746; 3,701,783; 3,733,201; 4,049,455; 4,095,984; 4,126,459; 4,149,886; 4,150,228; 4,211,562; 4,248,962; 4,259,437; 4,362,878; 4,409,323; 4,477,563; 4,782,012; 4,962,018; 4,500,634; 4,579,816; 4,607,004; 4,618,571; 4,678,739; 4,746,600; 4,746,601; 4,791,049; 4,857,447; 4,865,959; 4,880,342; 4,886,736; 4,937,179; 4,946,767; 4,948,716; 4,952,485; 4,956,269; 4,959,299; 4,966,835; 4,985,336 as well as in patent publications GB 1,560,240; GB 2,007,662; GB 2,032,914; GB 2,099,167; DE 2,842,063, DE 2,937,127; DE 3,636,824; DE 3,644,416 as well as the following European Patent Publications: 272,573; 335,319; 336,411; 346,899; 362,870; 365,252; 365,346; 373,382; 376,212; 377,463; 378,236; 384,670; 396,486; 401,612; 401,613.

DIR compounds are also disclosed in "Developer-Inhibitor-Releasing (DIR) Couplers for Color Photography," C. R. Barr, J. R. Thirtle and P. W. Vittum in *Photographic Science and Engineering,* Vol. 13, p. 174 (1969), incorporated herein by reference.

The photographic elements of the present invention, as is typical, provide the silver halide in the form of an emulsion. Photographic emulsions generally include a vehicle for coating the emulsion as a layer of a photographic element. Useful vehicles include both naturally occurring substances such as proteins, protein derivatives, cellulose derivatives (e.g., cellulose esters), gelatin (e.g., alkali-treated gelatin such as cattle bone or hide gelatin, or acid treated gelatin such as pigskin gelatin), deionized gelatin, gelatin derivatives (e.g., acetylated gelatin, phthalated gelatin, and the like), and others as described in *Research Disclosure I.* Also useful as vehicles or vehicle extenders are hydrophilic water-permeable colloids. These include synthetic polymeric peptizers, carriers, and/or binders such as poly(vinyl alcohol), poly(vinyl lactams), acrylamide polymers, polyvinyl acetals, polymers of alkyl and sulfoalkyl acrylates and methacrylates, hydrolyzed polyvinyl acetates, polyamides, polyvinyl pyridine, methacrylamide copolymers, and the like, as described in *Research Disclosure I.* The vehicle can be present in the emulsion in any amount useful in photographic emulsions. The emulsion can also include any of the addenda known to be useful in photographic emulsions.

Photographic elements of the present invention are preferably imagewise exposed using any of the known techniques, including those described in *Research Disclosure I,* section XVI. This typically involves exposure to light in the visible region of the spectrum, and typically such exposure is of a live image through a lens, although exposure can also be exposure to a stored image (such as a computer stored image) by means of light emitting devices (such as light emitting diodes, CRT and the like).

Photographic elements comprising the composition of the invention can be processed in any of a number of well-known photographic processes utilizing any of a number of well-known processing compositions, described, for example, in *Research Disclosure I,* or in T. H. James, editor, *The Theory of the Photographic Process,* 4th Edition, Macmillan, New York, 1977. In the case of processing a negative working element, the element is treated with a color developer (that is one which will form the colored image dyes with the color couplers), and then with a oxidizer and a solvent to remove silver and silver halide. In the case of processing a reversal color element, the element is first treated with a black and white developer (that is, a developer which does not form colored dyes with the coupler compounds) followed by a treatment to fog silver halide (usually chemical fogging or light fogging), followed by treatment with a color developer. Preferred color developing agents are p-phenylenediamines. Especially preferred are:

4-amino N,N-diethylaniline hydrochloride, 4-amino-3-methyl-N,N-diethylaniline hydrochloride, 4-amino-3-methyl-N-ethyl-N-(β-(methanesulfonamido) ethylaniline sesquisulfate hydrate, 4-amino-3-methyl-N-ethyl-N-(β-hydroxyethyl)aniline sulfate, 4-amino-3-β-(methanesulfonamido)ethyl-N,N-diethylaniline hydrochloride and 4-amino-N-ethyl-N-(2-methoxyethyl)-m-toluidine di-p-toluene sulfonic acid.

Dye images can be formed or amplified by processes which employ in combination with a dye-image-generating reducing agent an inert transition metal-ion complex oxidizing agent, as illustrated by Bissonette U.S. Pat. Nos. 3,748,138, 3,826,652, 3,862,842 and 3,989,526 and Travis U.S. Pat. No. 3,765,891, and/or a peroxide oxidizing agent as illustrated by Matejec U.S. Pat. No. 3,674,490, *Research Disclosure,* Vol. 116, December, 1973, Item 11660, and Bissonette *Research Disclosure,* Vol. 148, August, 1976, Items 14836, 14846 and 14847. The photographic elements can be particularly adapted to form dye images by such processes as illustrated by Dunn et al U.S. Pat. No. 3,822,129, Bissonette U.S. Pat. Nos. 3,834,907 and 3,902,905, Bissonette et al U.S. Pat. No. 3,847,619, Mowrey U.S. Pat. No. 3,904,413, Hirai et al U.S. Pat. No. 4,880,725, Iwano U.S. Pat. No. 4,954,425, Marsden et al U.S. Pat. No. 4,983,504, Evans et al U.S. Pat. No. 5,246,822, Twist U.S. Pat. No. 5,324,624, Fyson EPO 0 487 616, Tannahill et al WO 90/13059, Marsden et al WO 90/13061, Grimsey et al WO 91/16666, Fyson WO 91/17479, Marsden et al WO 92/01972. Tannahill WO 92/05471, Henson WO 92/07299, Twist WO 93/01524 and WO 93/11460 and Wingender et al German OLS 4,211,460.

Development is followed by bleach-fixing, to remove silver or silver halide, washing and drying.

The following examples illustrate the invention.

EXAMPLE 1

An AgBrI tabular silver halide emulsion (Emulsion E-1) was prepared containing 1.5% total iodide distributed as a homogeneous run iodide phase. The emulsion grains had an average thickness of 0.097 μm and average circular diameter of 3.2 μm. Emulsion E-1 was precipitated isothermally at 75° C. using regular gelatin and contained additionally 198.50 molar parts per million of $K_4Ru(CN)_6$ placed continuously throughout the precipitation.

The host emulsion E-1 as made was optimally chemically and spectrally sensitized by adding the hydroxybenzene HB3 at a concentration of $1.368\times10^{-3}$ mole/mole Ag, NaSCN, $1.066\times10^{-3}$ mole/mole Ag of the blue sensitizing dye DyeA, carboxymethyl-trimethyl-2-thiourea, bis(1,4,5-trimethyl-1,2,4-triazolium-3-thiolate) gold(I) tetrafluoroborate, and a benzothiazolium finish modifier, and then subjecting the emulsion to a heat cycle to 60° C. for 15 minutes. For some experimental variations, the fragmentable electron donating compound FED 2 was added to the emulsion after the heat cycle. The azaindene compound [(1,2,4)Triazolo(1,5-a)pyrimidin-7-ol, 5-methyl-, sodium salt], commonly referred to as TAI, was added after the fragmentable electron donor.

The epitaxial depositions were prepared in the manner prescribed by Daubendiek et al U.S. Pat. No. 5,576,168; Deaton et al U.S. Pat. No. 5,582,965 and Daubendiek et al U.S. Pat. No. 5,573,902. Two types of epitaxial depositions were made; a chloride epitaxy (yielding test emulsion E-1 Cl) and a mixed halide epitaxy (yielding test emulsion E-1 MH). The vAg of a 0.5 mole aliquoit of host emulsion E-1 was raised to 130 mv at 40° C. via the addition of a single jet of $AgNO_3$. Subsequently, 2 mole percent of NaCl was added followed by 0.5 mole percent of KI. Dye A was then introduced at a concentration intended to give 75% surface saturation of the emulsion. Halide salts were then introduced; six mole percent NaCl was added to give emulsion E-1 Cl, or else 2.52 percent NaCl, 2.52 percent NaBr and 0.96 percent KI to give emulsion E-1 MH. The latter emulsion had a mixed halide epitaxy with a nominal composition of 42% chloride, 42% bromide and 16% iodide. Subsequent to the addition of the halide salts, a single jet addition of $AgNO_3$ was run for a total of 4.44 mole percent. The nominal bulk epitaxy in both cases is calculated to be 6 percent.

The spectrochemical sensitizations of the epitaxied emulsions followed the same protocol as that of the host emulsion with the exception of a milder heat cycle, 10 minutes at 50° C. This was then followed with the addition of 0.489 mmole/mole of the compound 3'-acetamido,1-phenyl, 5-mercaptotetrazole and subsequently the fragmentable electron donor compound.

Coatings were then prepared consisting of sensitized silver halide emulsion at a laydown of 100 mg/ft$^2$, 150 mg/ft$^2$ of the yellow dye forming coupler YY-1, and a gelatin vehicle at 300 mg/ft$^2$. An overcoat of gelatin at 80 mg/ft$^2$ was subsequently applied containing bisvinylsulfonylmethyl ether hardener at 1.75% wt/wt of gelatin.

For photographic evaluation, each of the coating strips was exposed for 0.01 sec to a 3000° K color temperature tungsten lamp filtered to give an effective color temperature of 5500° K and further filtered through both a 0.3 density inconel filter and a Kodak Wratten filter number 2B and a step wedge ranging in density from 0 to 4 density units in 0.2 density steps. This filter passes only light of wavelengths longer than 400 nm, thus giving light absorbed mainly by the sensitizing dye. The exposed film strips were processed in standard Kodak C-41 chemistry. Relative speed was metered at the intersection of the tangents to the straight line portion of the H & D curve and the asymptotic Dmin region of the H & D curve and is reported as log relative sensitivity. The relative speed of the emulsion without epitaxy and without the fragmentable electron donor is set equal to 1.00.

The photographic data in Table I are taken on emulsion E-1 and its two epitaxial derivatives, E-1 Cl and E-1 MH.

The following compounds were used in this example:

Dye A

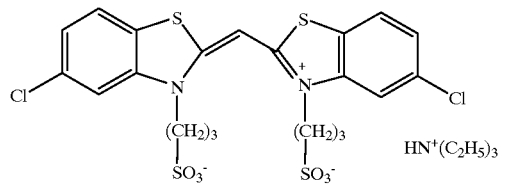

-continued

Coupler YY-1

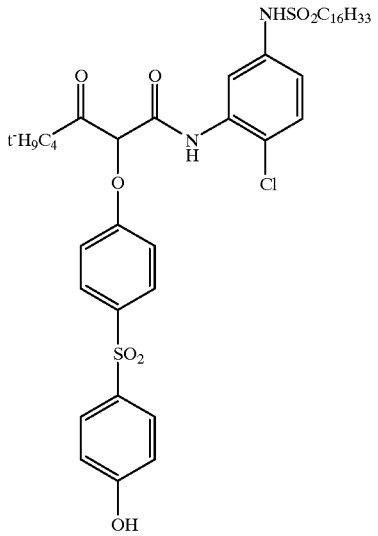

TABLE I

Dmin, Gamma and Dyed Speed, Effects of FED and Emulsion E-1

| Test No. | Emulsion | Amount of FED 2 added ($10^{-6}$ mol/mol Ag) | Photographic Sensitivity Dmin | Gamma | Speed (log S) | Remarks |
|---|---|---|---|---|---|---|
| 1 | E-1 | 0.0 | 0.11 | 2.19 | 1.00 | comparison |
| 2 | E-1 | 1.95 | 0.13 | 2.17 | 1.22 | comparison |
| 3 | E-1 Cl | 0.0 | 0.88 | 2.26 | 1.61 | comparison |
| 4 | E-1 Cl | 1.95 | 1.00 | 1.84 | 1.91 | invention |
| 5 | E-1 MH | 0.0 | 0.10 | 0.82 | 1.99 | comparison |
| 6 | E-1 MH | 1.95 | 0.23 | 0.99 | 2.32 | invention |

The presence of the fragmentable electron donor clearly enhances the speed of the host emulsion E-1 (test no. 2) by a modest amount (0.22 log E) with a very minimal Dmin increase. The pure chloride epitaxied emulsion E-1 Cl is stantially faster than the host emulsion, albeit at much greater Dmin (test no. 3). The speed increase obtained with the presence of the fragmentable electron r FED 2 in the nominally pure chloride epitaxied emulsion (test no. 4) is greater than that found on the host emulsion but the attendant Dmin is outside the range of practical utility. A very substantial increase in emulsion sensitivity is found for the emulsion containing both the mixed halide epitaxy and FED 2 (test no. 6). Relative to the comparative emulsions with no epitaxy or FED (test no. 1) of with epitaxy and no FED (test no 5), this sensitivity increase (test no. 6) is 1.32 log E and 0.33 log E, respectively. These sensitivity increases are obtained with only very minor increases in Dmin.

The above experiment was repeated for the mixed halide epitaxy with a variety of different fragmentable electron donors or deprotonating electron donors. The data are summarized in Table II below. A concentration range for each compound was examined but we report only that concentration giving the optimal Dmin/Speed performance. In Table II, the relative speed of the emulsion with mixed halide epitaxy but no fragmentable electron donor is set equal to 1.00.

TABLE II

Dmin, Gamma and Dyed Speed, Effects of Various Two Electron Sensitizers on the Mixed Halide Epitaxy Emulsion.

| Test No. | Compound | Concentration ($10^{-6}$ mol/mol Ag) | Photographic Sensitivity Dmin | Gamma | Speed | Remarks |
|---|---|---|---|---|---|---|
| 10 | none | 0.0 | 0.11 | 0.96 | 1.00 | comparison |
| 11 | FED 2 | 0.97 | 0.18 | 0.89 | 1.14 | invention |
| 12 | FBD 6 | 1.65 | 0.17 | 0.98 | 1.07 | invention |
| 13 | FED 1 | 16.53 | 0.16 | 0.91 | 1.15 | invention |
| 14 | FED 7 | 199.24 | 0.18 | 0.95 | 1.16 | invention |
| 15 | FED 3 | 220.0 | 0.20 | 0.88 | 1.06 | invention |
| 16 | FED 5 | 4.97 | 0.16 | 0.92 | 1.10 | invention |
| 17 | FED 4 | 9.83 | 0.14 | 0.94 | 1.14 | invention |

The data in Table II show that a wide variety of fragmentable electron donating compounds can give speed gains with only small fog increases on this emulsion sensitized with mixed halide epitaxy.

EXAMPLE 2

Emulsion E-2 was precipitated with an iodide distribution similar to E-1 only the phase composition was 4%. An external nucleator was used to make subcritical AgBrI nuclei which were then fed to a reactor held at 70° C. These nuclei ripened onto a growing tabular emulsion to produce an emulsion of dimensions 3.56 μm by 0.085 μm. This experimental arrangement has been described in:

U.S. Pat. No. 4,334,012—Silver Halide Precipitation Process with Deletion of Materials—Mignot.

U.S. Pat. No. 4,336,328—Silver Halide Precipitation Process with Deletion of Materials through the Reaction Vessel—Brown et al.

U.S. Pat. No. 5,250,403 —Ultrathin AgBrI T-Grain emulsions (process disclosed in examples). The entire disclosures of these patents are incorporated herein by reference.

There was no transition metal dopant present during the precipitation.

The mixed halide epitaxy procedure was carried out at a bulk 6 percent level as before except that the halide composition was 46 percent chloride, 46 percent bromide and 8 percent iodide. For some epitaxies, the ruthenium hexacyanide dopant was introduced into the epitaxy at a level of 60 molar parts per million (bulk crystal) in a manner described in Olm et al U.S. Pat. Nos. 5,503,970 and 5,576,171. The spectro-chemical sensitization, coating, exposing and processing conditions were identical to those given previously.

In Table III below are the relevant photographic results for emulsion E-2 and its epitaxied variants. The relative speed of the emulsion with no dopant and no fragmentable electron donor is set equal to 1.00.

TABLE III

Dmin, Gamma and Dyed Speed, for FED 2 and Epitaxied Emulsion E-2

| Test No. | Treatment | Photographic Sensitivity Dmin | Gamma | Speed | Remarks |
|---|---|---|---|---|---|
| 19 | No Dopant, No FED 2 | 0.17 | 1.06 | 1.00 | comparison |
| 20 | No Dopant, 1.95 mppm | 0.58 | 0.91 | 1.05 | comparison |

TABLE III-continued

| Test No. | Treatment | Photographic Sensitivity Dmin | Gamma | Speed | Remarks |
|---|---|---|---|---|---|
| | FED 2 | | | | |
| 21 | with Dopant, no FED 2 | 0.18 | 1.0 | 1.09 | comparison |
| 22 | with Dopant, 1.95 mppm FED 2 | 0.43 | 0.76 | 1.25 | invention |

Dmin, Gamma and Dyed Speed, for FED 2 and Epitaxied Emulsion E-2

In the emulsion that does not contain ruthenium dopant in the epitaxy, the presence of the fragmentable electron donor gives a relatively small increase in sensitivity and a large Dmin increase (tests no. 19 and 20). The presence of the dopant clearly minimizes the Dmin increase associated with FED 2 and additionally while allows a much high relative speed to be achieved. This speed position is greater than the algebraic sum of the two components ie, a synergy exists between the dopant and the FED.

EXAMPLE 3

Emulsion E-3 was precipitated, without intentionally adding iodide, as a pure silver bromide in the presence of PLURONIC-31R1™ as described in Deaton et al U.S. Pat. No. 5,726,007 giving dimensions of 3.51 $\mu$m by 0.059 $\mu$m and a surface area measurement of 865 $m^2$/Ag-mole. No dopants were used during precipitation.

The sensitization used Dye A at 85 percent surface coverage. The epitaxial procedure, also described in U.S. Pat. No. 5,726,007, added a total of 4 percent to the bulk silver, with a nominal halide composition of 42 percent chloride, 42 percent bromide and 16 percent iodide. Ruthenium hexacyanide dopant was introduced into the epitaxy at a level of 18 molar parts per million (bulk crystal) using methods described in Olm et al U.S. Pat. Nos. 5,503,970 and 5,576,171.

The epitaxied emulsion was chemically sensitized using carboxymethyl-trimethyl-2-thiourea, bis(1,4,5-trimethyl-1,2,4-triazolium-3-thiolate) gold(I) tetrafluoroborate, and a benzothiazolium finish modifier followed by a heat cycle to 50° C. for 20 minutes. After cooling the emulsion was further treated with the finish modifier, held for 5 minutes and tetraazaindene (TAI) was added at 1.75 g/mole Ag.

The emulsion was coated without and with several levels of FED 2. The coatings were assembled in a format consisting of 75 mg/$ft^2$ silver, 150 mg/$ft^2$ of the cyan dye forming coupler CC-1, and 300 gel on acetate support with remjet antihalation. To the emulsion layer was also added the hydroxybenzene HB3, and additional TAI. The emulsion layer was topped with a 250 mg/$ft^2$ gel overcoat containing bisvinylsulfonylmethyl ether hardener at 1.8 percent of the total gel.

Each strip was exposed using a 5500K lamp source through a Kodak Wratten 2B filter and a step wedge for 0.01 second. The exposed strips were processed in standard Kodak C-41 chemistry.

Speed was measured as described in Example 1. Gamma was measured as the maximum for the fitted H and D curve. Relative speed for the coating with no FED 2 was set equal to 1.00.

CC-1

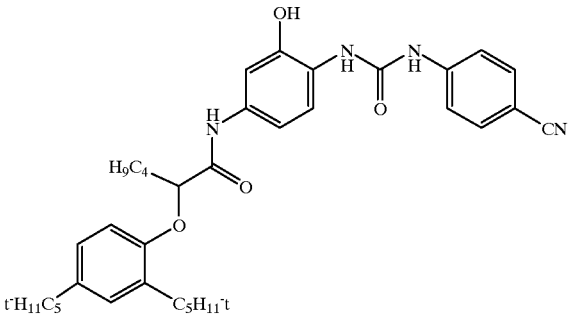

TABLE IV

Dmin, Gamma and Dyed Speed, for FED 2 and Epitaxied Emulsion E-3

| Test No. | Amount of FED 2 added (mg/mol Ag) | Photographic Sensitivity Dmin | Gamma | Speed | Remarks |
|---|---|---|---|---|---|
| 15 | 0.0 | 0.08 | 2.43 | 1.00 | comparison |
| 16 | 0.3 | 0.09 | 2.30 | 1.17 | invention |
| 17 | 0.6 | 0.10 | 2.29 | 1.22 | invention |
| 18 | 0.9 | 0.09 | 2.30 | 1.23 | invention |

As can be seen from the data of Table IV, the addition of various levels of FED 2 gave substantial increases in speed with minimal effects on Dmin and gamma.

The invention has been described in detail with particular reference to preferred embodiments, but it will be understood that variations and modifications can be effected within the spirit and scope of the invention.

What is claimed is:

1. A silver halide photographic element comprising at least one radiation sensitive silver halide emulsion layer comprising tabular silver halide grains that have been epitaxially sensitized by epitaxially grown silver halide comprising a mixture of silver iodide silver chloride, and silver bromide, and further comprising a transition metal dopant, and a fragmentable electron donor compound of the formula X—Y' or a compound which contains a moiety of the formula —X—Y';

wherein

X is an electron donor, Y' is a leaving proton H or a leaving group, with the proviso that if Y' is a proton, a base β', is covalently linked directly or indirectly to X, and wherein:

1) X—Y' has an oxidation potential between 0 and about 1.4 V; and 2) the oxidized form of X—Y' undergoes a bond cleavage reaction to give the radical $X^{\bullet}$ and the leaving fragment Y';

and, optionally, 3) the radical $X^{\bullet}$ has an oxidation potential≦about −0.7 (that is, equal to or more negative than about −0.7V).

2. A photographic element according to claim 1, wherein greater than 50 percent of total grain projected area is accounted for by tabular grains having {111} major faces and containing greater than 50 mole percent bromide, based on silver.

3. A photographic element according to claim 2, wherein the silver halide grains have silver chlorobromoiodide corner epitaxy.

4. A photographic element according to claim 1, wherein the dopant is ruthenium hexacyanide.

5. A photographic element according to claim 1, wherein X is of structure (I):

(I)

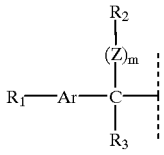

$R_1$=R, carboxyl, amide, sulfonamide, halogen, $NR_2$, $(OH)_n$, $(OR')_n$, or $(SR)_n$;

n=1–3;

$R_2$=R, Ar';

$R_3$=R, Ar';

$R_2$ and $R_3$ together can form a 5- to 8-membered ring wherein:

m=0,1;

Z=O, S, Se, Te;

$R_2$ and Ar=can be linked to form 5 to 8-membered ring;

$R_3$ and Ar=can be linked to form 5 to 8-membered ring;

Ar'=aryl group or heterocyclic group; and

R=a hydrogen atom or an unsubstituted or substituted alkyl group.

6. A photographic element according to claim 5, wherein the compound of Structure (I) is selected from:

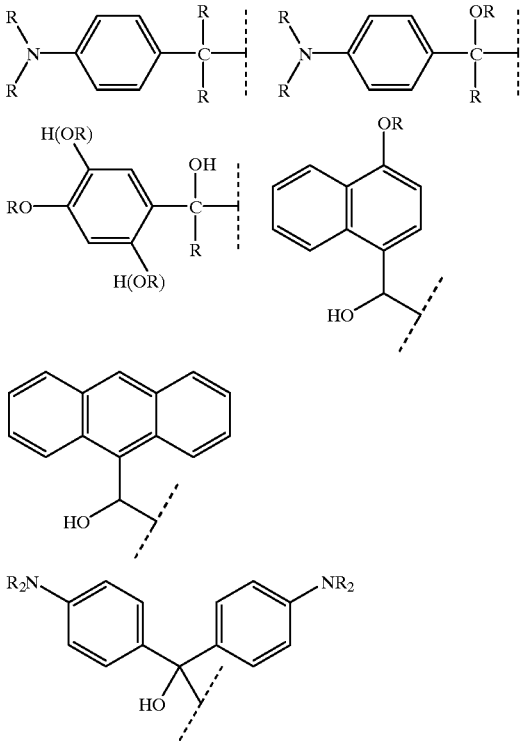

-continued

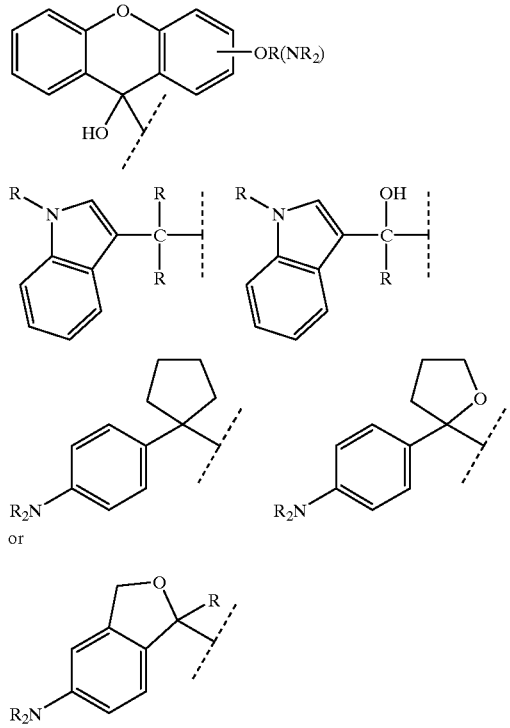

wherein each R is independently a hydrogen atom or a substituted or unsubstituted alkyl group.

7. A photographic element according to claim 1, wherein X is a compound of structure (II):

(II)

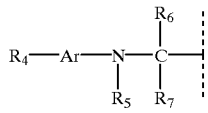

wherein:

Ar=aryl group or heterocyclic group $R_4$=a substituent having a Hammett sigma value of −1 to +1, $R_5$=R or Ar'

$R_6$ and $R_7$=R or Ar'

$R_5$ and Ar=can be linked to form a 5- to 8-membered ring;

$R_6$ and Ar=can be linked to form a 5- to 8-membered ring (in which case, $R_6$ can be a hetero atom);

$R_5$ and $R_6$ can be linked to form a 5- to 8-membered ring;

$R_6$ and $R_7$ can be linked to form a 5- to 8-membered ring;

Ar'=aryl group or heterocyclic group; and

R=hydrogen atom or an unsubstituted or substituted alkyl group.

8. A photographic element according to claim 7, wherein wherein X is selected from:

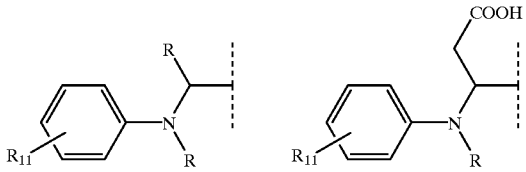

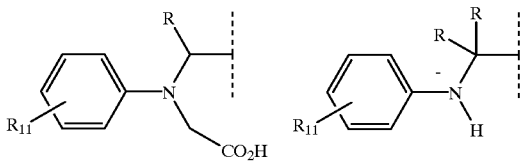

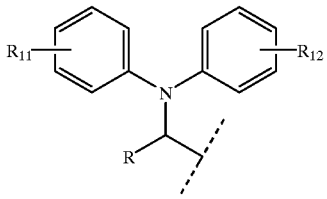

$R_{11}$ and $R_{12}$ = { H, alkyl, alkoxy, alkylthio, halo, carbamoyl; carboxyl, amido, formyl, sulfonyl, sulfonamido, nitrile }

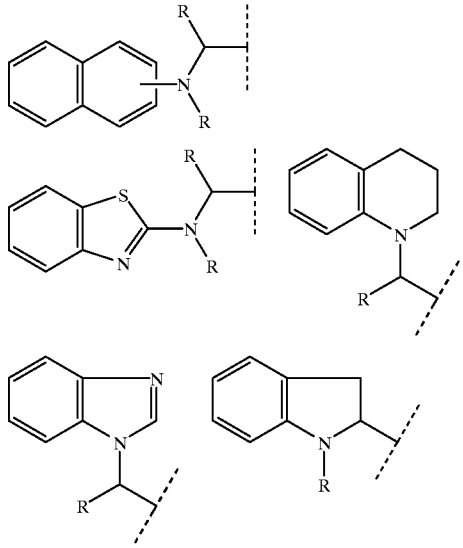

or

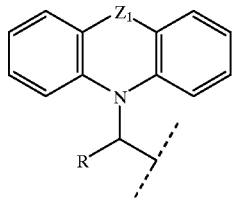

$Z_1$=a covalent bond, S, O, Se, NR, $CR_2$, CR═CR, or $CH_2CH_2$ or

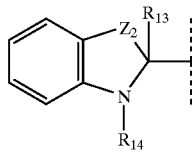

$Z_2$=S, O, Se, NR, $CR_2$, CR═CR; $R_{13}$, an alkyl, substituted alkyl or aryl group, and $R_{14}$=H, an alkyl, substituted alkyl, or aryl group.

9. A photographic element according to claim 1, wherein X is a compound of structure (III):

(III)

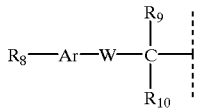

wherein:

W=O, S, or Se;

Ar=aryl group or heterocyclic group;

$R_8$=R, carboxyl, $NR_2$, $(OR)_n$, or $(SR)_n$ (n=1–3);

$R_9$ and $R_{10}$=R, or Ar';

$R_9$ and Ar=can be linked to form a 5- to 8-membered ring;

Ar'=aryl group or heterocyclic group; and

R=a hydrogen atom or an unsubstituted or substituted alkyl group.

10. A photographic element according to claim 9, wherein X is selected from:

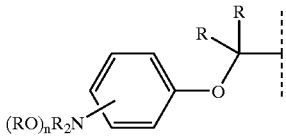

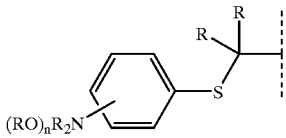

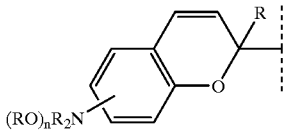

or

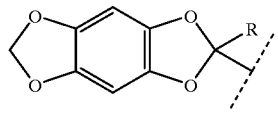

and n=1–3.

11. A photographic element according to claim 1, wherein X is of structure (IV):

(IV)

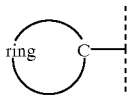

wherein:

"ring" represents a substituted or unsubstituted 5-, 6- or 7-membered unsaturated ring.

12. A photographic element according to claim 11, wherein X is selected from:

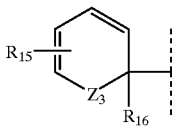

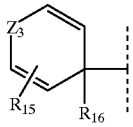

or

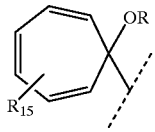

$Z_3$=O, S Se, or NR $R_{15}$=R, OR, or $NR_2$ $R_{16}$=an alkyl or substituted alkyl group.

13. A photographic element according to claim 1, wherein Y' is:

(1) X', where X' is an X group as defined in structures I–IV and may be the same as or different from the X group to which it is attached (2)

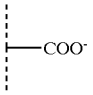

(3)

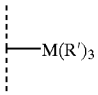

where M = Si, Sn or Ge; and R' = an alkyl or substituted alkyl group (4)

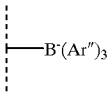

where Ar" = an aryl or substituted aryl group, or (5)

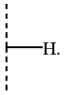

14. A photographic element according to claim 1, wherein the fragmentable electron donor compound is selected from compounds of the formulae:

$Z—(L—X—Y')_k$ $A—(L—X—Y')_k$ $(A—L)_k—X—Y'$ $Q—X—Y'$ $A—(X—Y')_k$ $(A)_k—X—Y'$ $Z—(X—Y')_k$ or $(Z)_k—X—Y'$ wherein:

Z is a light absorbing group;

k is 1 or 2;

A is a silver halide adsorptive group;

L represents a linking group containing at least one C, N, S, P or O atom; and

Q represents the atoms necessary to form a chromophore comprising an amidinium-ion, a carboxyl-ion or dipolar-amidic chromophoric system when conjugated with X—Y'.

15. A photographic element according to claim 14, wherein the fragmentable electron donor compound is of the formula:

$Z—(L—X—Y')_k$ $Z—(X—Y')_k$ or $(Z)_k—X—Y'$ wherein Z is derived from a cyanine dye, complex cyanine dye, merocyanine dye, complex merocyanine dye, homopolar cyanine dye, styryl dye, oxonol dye, hemioxonol dye, or hemicyanine dye.

16. A photographic element according to claim 14, wherein the fragmentable electron donor compound is of the formula:

$A—(L—X—Y')_k$ $(A—L)_k—X—Y'$ $A—(X—Y')_k$ or $(A)_k—X—Y'$ wherein: A is a silver-ion ligand moiety or a cationic surfactant moiety.

17. A photographic element according to claim 16, wherein A is selected from the group consisting of: i) sulfur acids and their Se and Te analogs, ii) nitrogen acids, iii) thioethers and their Se and Te analogs, iv) phosphines, v) thionamides, selenamides, and telluramides, and vi) carbon acids.

18. A photographic element according to claim 14, wherein the fragmentable electron donor compound is of the formula:

$Q—X—Y'$ wherein Q represents a chromophoric system comprising a cyanine, complex cyanine, hemicyanine, merocyanine, or complex merocyanine dye.
19. A photographic element according to claim 1, wherein the fragmentable electron donor compound is selected from the group consisting of:
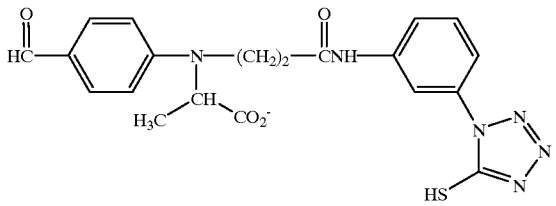
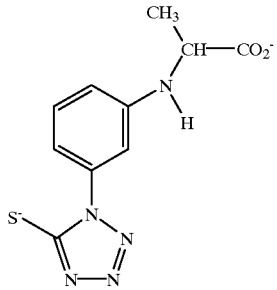
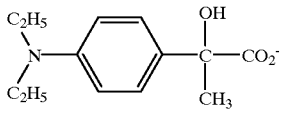
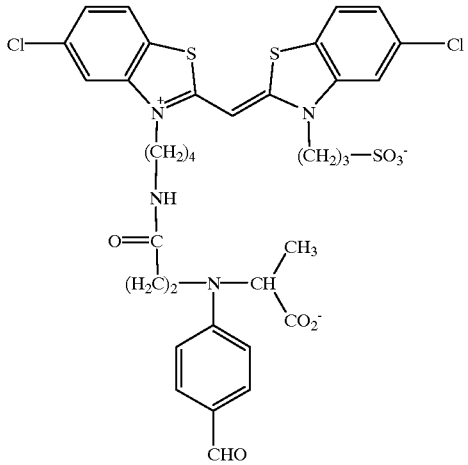
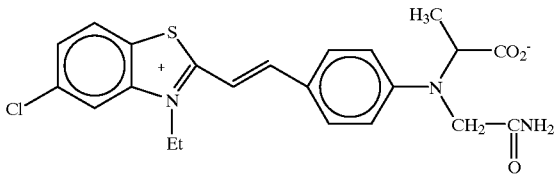
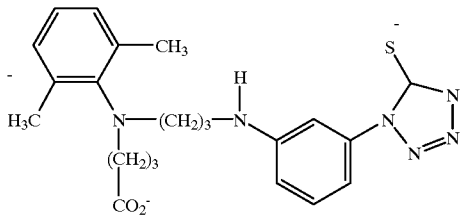
-continued
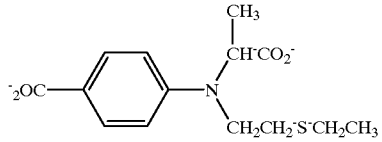
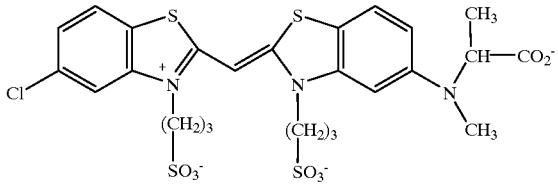
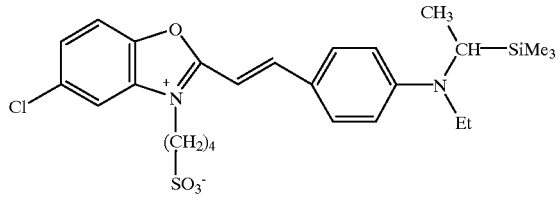
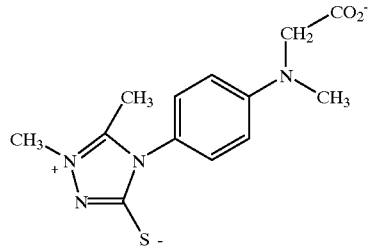
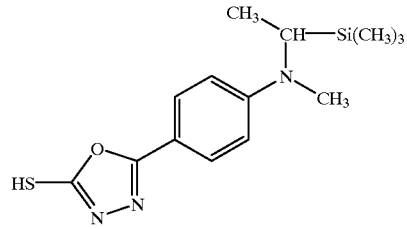
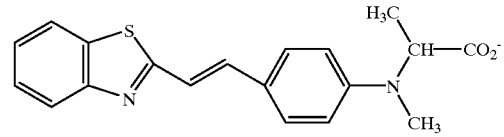
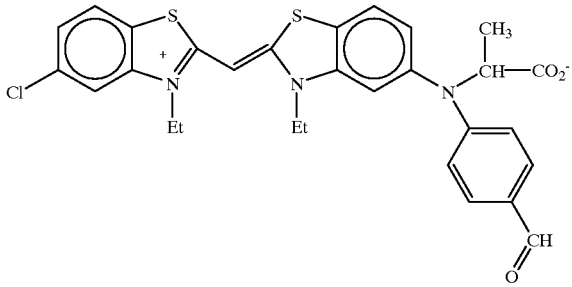
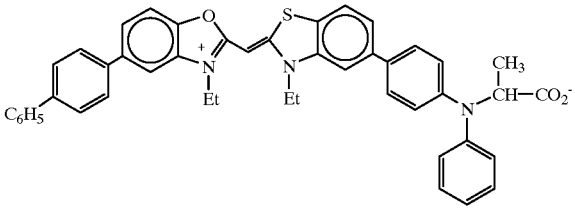

-continued
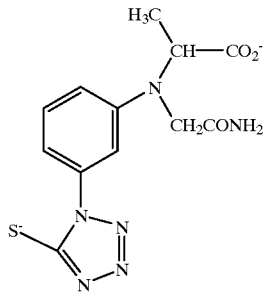
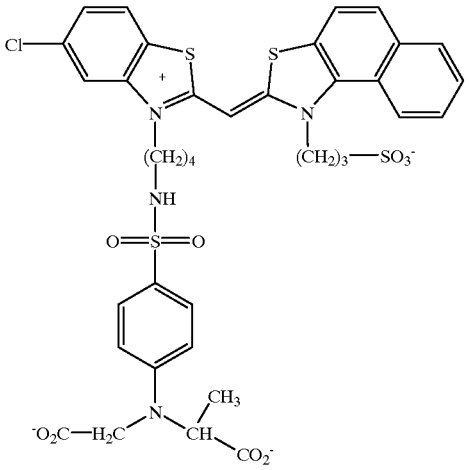
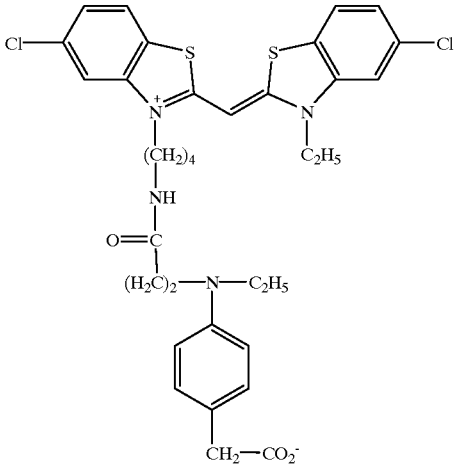
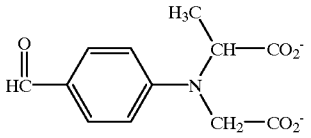
-continued
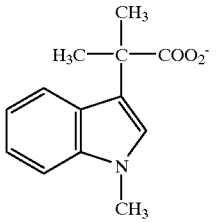
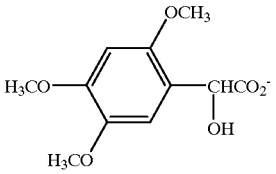
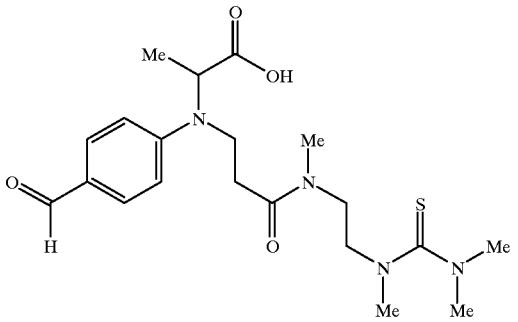
and
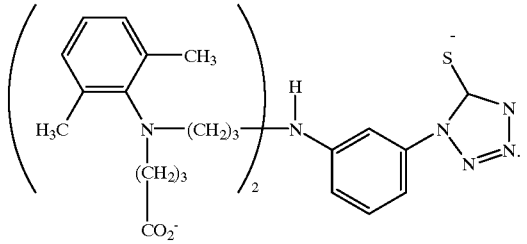
20. A photographic element according to claim 19, wherein the fragmentable electron donor compound is a compound of the formula:
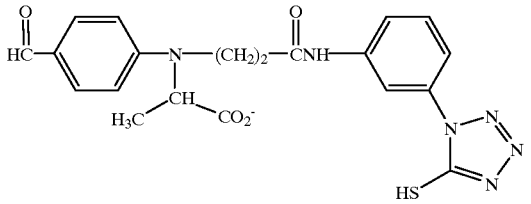

-continued

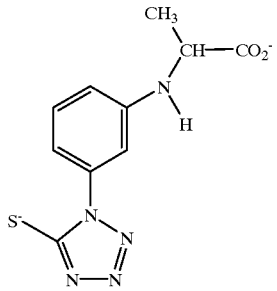

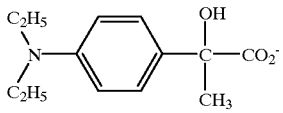

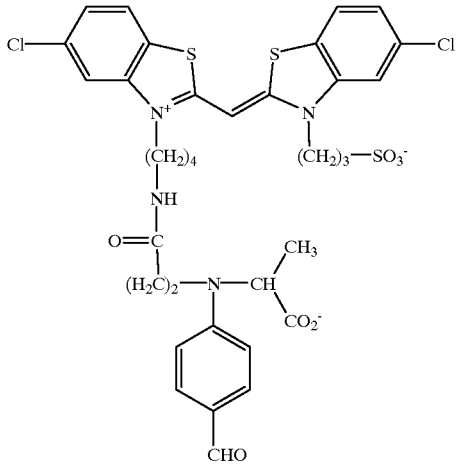

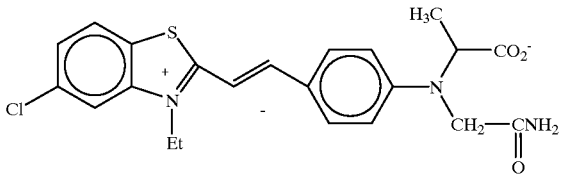

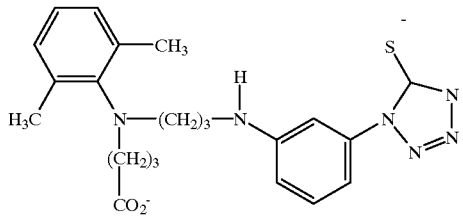

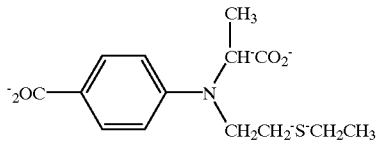

or

-continued

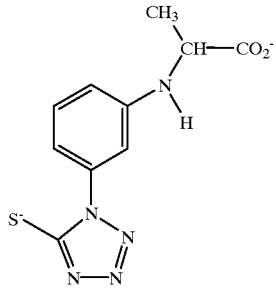

21. A photographic element according to claim 1, wherein the silver halide emulsion has been chemically sensitized with a compound of the formula:

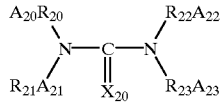

wherein $X_{20}$ is sulfur, selenium or tellurium;

each of $R_{20}$, $R_{21}$, $R_{22}$ and $R_{23}$ can independently represent an alkylene, cycloalkylene, alkarylene, aralkylene or heterocyclic arylene group or, taken together with the nitrogen atom to which they are attached, $R_{20}$ and $R_{21}$ or $R_{22}$ and $R_{23}$ complete a 5 to 7 member heterocyclic ring; and each of $A_{21}$, $A_{21}$, $A_{22}$ and $A_{23}$ can independently represent hydrogen or a radical comprising an acidic group, with the proviso that at least one $A_{20}R_{21}$ to $A_{22}R_{23}$ contains an acidic group bonded to the urea nitrogen through a carbon chain containing from 1 to 6 carbon atoms.

22. A photographic element according to claim 1, wherein the silver halide emulsion has been chemically sensitized with a compound of the formula:

$$AuL''_2{}^+X_2^-$$

or $$AuL''(L^1)^+X_2^-$$

wherein

L" is a mesoionic compound;

$X_2$ is an anion; and $L^1$ is a Lewis acid donor.

23. A photographic element according to claim 1, wherein said epitaxially grown silver halide comprises at least about 8 mole percent silver iodide.

24. A photographic element according to claim 1, wherein said epitaxially grown silver halide comprises substantially equal molar amounts of silver chloride and silver bromide.

* * * * *